US011566389B2

(12) United States Patent
Menier et al.

(10) Patent No.: US 11,566,389 B2
(45) **Date of Patent: *Jan. 31, 2023**

(54) GATE FOR CONTROLLING ONCOMING TRAFFIC ON A ROADWAY

(71) Applicant: Systèmes Versilis Inc., Laval (CA)

(72) Inventors: Jean-François Menier, Pointe-Claire (CA); Vincent Shebib Loiselle, Montreal (CA); Nicholas Gendron, Laval (CA)

(73) Assignee: SYSTEMES VERSILIS INC., Laval (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/535,635

(22) Filed: Nov. 25, 2021

(65) Prior Publication Data

US 2022/0090337 A1 Mar. 24, 2022

Related U.S. Application Data

(63) Continuation of application No. 16/614,751, filed as application No. PCT/CA2018/050581 on May 16, 2018.

(Continued)

(51) Int. Cl.
*E01F 9/00* (2016.01)
*E01F 13/06* (2006.01)

(52) U.S. Cl.
CPC ..... *E01F 13/06* (2013.01); *E01F 9/00* (2013.01)

(58) Field of Classification Search
CPC ..... E01F 13/06; E01F 9/00
See application file for complete search history.

(56) References Cited

U.S. PATENT DOCUMENTS 2,137,193 A * 11/1938 Stafford ..... B61L 29/04 49/192
3,024,550 A * 3/1962 Kudera, Jr. ..... B61L 29/04 49/192

(Continued)

FOREIGN PATENT DOCUMENTS

DE 9411150 U1 * 11/1994
DE 10108012 A1 * 10/2001 ..... E01F 13/04

(Continued)

OTHER PUBLICATIONS

International Search Report dated Aug. 3, 2018 in connection with International Patent Application No. PCT/CA2018/050581, 4 pages.

(Continued)

*Primary Examiner* — Daniel J Troy
*Assistant Examiner* — Daniel Alvarez

(57) ABSTRACT

A gate for controlling oncoming traffic on a roadway (e.g. a highway). The gate comprises an arm movable between an extended position in which the arm extends into a given portion of the roadway to inform the oncoming traffic that the given portion of the roadway is closed and a retracted position in which the arm does not extend into the given portion of the roadway and thus leaves open the given portion of the roadway for the oncoming traffic. The gate also comprises a control system comprising an actuator and configured to support the arm and move the arm between the extended position and the retracted position. The arm may be quite long and vertically wide to close more of the roadway and be clearly visible to the oncoming traffic, while the gate may be crash-tested (i.e., compliant with crash-testing criteria), the control system may be compact, and the gate may be reusable and easily repairable if crashed into.

30 Claims, 35 Drawing Sheets

Related U.S. Application Data

(60) Provisional application No. 62/506,959, filed on May 16, 2017.

(56) References Cited

U.S. PATENT DOCUMENTS

| | | | | | |
|---|---|---|---|---|---|
| 3,135,062 | A * | 6/1964 | Guerco | E01F 13/06 | 49/192 |
| 4,050,401 | A * | 9/1977 | Kelly | E01F 9/615 | 116/63 P |
| 4,318,079 | A | 3/1982 | Dickinson | | |
| 4,416,085 | A | 11/1983 | Lybescker et al. | | |
| 4,735,018 | A | 4/1988 | Duncan | | |
| 4,897,960 | A * | 2/1990 | Barvinek | B61L 29/04 | 49/237 |
| 5,097,790 | A * | 3/1992 | Massey | E01F 13/06 | 116/63 P |
| 5,459,963 | A * | 10/1995 | Alexander | E01F 1/00 | 49/34 |
| 5,466,088 | A * | 11/1995 | Nasatka | E01F 13/08 | 404/6 |
| 5,720,132 | A * | 2/1998 | Renner | E06B 11/04 | 49/273 |
| 5,867,939 | A | 2/1999 | Merril | | |
| 6,006,861 | A * | 12/1999 | Clinton | E01F 13/06 | 182/97 |
| 6,119,399 | A | 9/2000 | McCain et al. | | |
| 7,098,807 | B2 * | 8/2006 | Seguin | E01F 9/669 | 404/9 |
| 7,342,510 | B2 | 3/2008 | Pate | | |
| 9,972,205 | B2 * | 5/2018 | Beaulieu | E01F 9/30 | |
| 2003/0159356 | A1 * | 8/2003 | Russell | E01F 13/06 | 49/226 |
| 2005/0063778 | A1 * | 3/2005 | Connors | E01F 13/02 | 404/9 |
| 2007/0126598 | A1 * | 6/2007 | Carter | E01F 13/06 | 340/908 |
| 2010/0329781 | A1 * | 12/2010 | Conant | E01F 13/02 | 404/6 |
| 2012/0210646 | A1 | 8/2012 | Shaw et al. | | |
| 2013/0000406 | A1 * | 1/2013 | Parsadayan | E05F 15/611 | 73/514.39 |
| 2013/0314254 | A1 | 11/2013 | Neff | | |
| 2014/0360680 | A1 | 12/2014 | Burgin | | |
| 2014/0363229 | A1 | 12/2014 | Lumsden | | |
| 2015/0139726 | A1 | 5/2015 | Burgin | | |
| 2016/0032545 | A1 * | 2/2016 | Lumsden | F21S 4/28 | 404/6 |
| 2019/0242080 | A1 | 8/2019 | Pierson et al. | | |
| 2020/0109530 | A1 | 4/2020 | Menier et al. | | |

FOREIGN PATENT DOCUMENTS

| | | | | | |
|---|---|---|---|---|---|
| DE | 202015101299 | U1 * | 7/2016 | | |
| FR | 2650846 | A1 * | 2/1991 | | |
| FR | 2735800 | A1 * | 12/1996 | E01F 13/06 | |
| FR | 2768447 | A1 * | 3/1999 | E01F 13/00 | |
| FR | 2884532 | A1 * | 10/2006 | E01F 13/06 | |
| KR | 200370279 | | 12/2004 | | |
| KR | 20090079324 | A * | 7/2009 | | |
| KR | 101199651 | B1 * | 11/2012 | | |
| KR | 101520243 | | 5/2015 | | |
| KR | 20140148044 | A * | 6/2016 | | |
| WO | WO-2016175392 | A1 * | 11/2016 | E01F 13/04 | |
| WO | 2018209440 | | 11/2018 | | |

OTHER PUBLICATIONS

Written Opinion dated Aug. 3, 2018 in connection with International Patent Application No. PCT/CA2018/050581, 6 pages.

International Preliminary Report on Patentability dated Sep. 6, 2019 in connection with International Patent Application No. PCT/CA2018/050581, 64 pages.

Non-Final Office Action dated Mar. 16, 2022 in connection with U.S. Appl. No. 16/614,751, 43 pages.

* cited by examiner

GATE FOR CONTROLLING ONCOMING TRAFFIC ON A ROADWAY

CROSS-REFERENCE TO RELATED APPLICATION

This application is a continuation of U.S. patent application Ser. No. 16/614,751 filed on Nov. 18, 2019 which is a National Phase Entry of International PCT Application No. PCT/CA2018/050581 filed on May 16, 2018 which claims priority from U.S. Provisional Patent Application No. 62/506,959 filed on May 16, 2017. The aforementioned applications are hereby incorporated by reference herein.

FIELD

This disclosure generally relates to control of traffic on roadways and, more particularly, to gates for controlling oncoming traffic.

BACKGROUND

Road closure gates are used for controlling oncoming traffic on a roadway, notably by informing the oncoming traffic that at least part of the roadway is closed, for lane closure (i.e., closing a lane, such as a highway lane, a high-occupancy toll (HOT) lane, a high-occupancy vehicle (HOV) lane, etc.), ramp access control (e.g., on-ramp or off-ramp access control), tunnel/bridge closure, work-zone lane closure, weather-related access control, and other traffic control measures.

Unlike resistance gates (also sometimes referred to as "resistance barriers" or "final barriers"), certain road closure gates (e.g., sometimes referred to as warning gates) are "forgiving" in that they allow oncoming vehicles to pass through them if crashed into, i.e., are not designed to stop the oncoming vehicles.

Existing road closure gates are useful but may sometimes be limited in how they can be used. For example, in some cases, a gate may be limited in length and visibility and thus in its ability to close more of a roadway because of issues that would arise from additional weight, including greater forces to support it and potential for greater damage and injury if crashed into. Some gates may be highly visible but limited in length, while others may be longer but inadequately visible for some purposes (e.g., highways or other high-speed facilities).

For these and other reasons, there is a need to improve gates for controlling oncoming traffic on roadways.

SUMMARY

According to various aspects of this disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway and thus leaves open the given portion of the roadway for the oncoming traffic. The gate also comprises a control system comprising an actuator and configured to support the arm and move the arm between the extended position and the retracted position. The arm may be quite long and vertically wide to close more of the roadway and be clearly visible to the oncoming traffic, while the gate may be crash-tested (i.e., compliant with crash-testing criteria), the control system may be compact, and the gate may be reusable and easily repairable if crashed into.

For example, in accordance with an aspect of this disclosure, there is provided a gate for controlling oncoming traffic on a roadway. The gate comprises: an arm movable between an extended position in which the arm extends into a given portion of the roadway to inform the oncoming traffic that the given portion of the roadway is closed and a retracted position in which the arm does not extend into the given portion of the roadway; and a control system comprising an actuator and configured to support the arm and move the arm between the extended position and the retracted position. A height of a longitudinal part of the arm in the extended position from a surface of the roadway is at least 55 inches.

In accordance with another aspect of this disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. A height of a longitudinal part of the arm in the extended position from a surface of the roadway is greater than a height of a passenger car complying with MASH crash-testing.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. A height of a longitudinal part of the arm in the extended position from a surface of the roadway is no less than a height of a pickup truck complying with MASH crash-testing.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. The gate is MASH crash-tested.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. The gate is compliant with at least one of (i) MASH evaluation criteria of Test Level 3 Support Structures test matrices and (ii) MASH evaluation criteria of Test Level 3 Work Zone Traffic Control Devices test matrices.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. The arm is configured such that a deflection of the arm at a wind speed of 100 km/h is no more than 15°.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. A ratio of a width of the arm over a length of the arm in the extended position is at least 10%.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. A ratio of a dimension of the control system in a longitudinal direction of the arm in the extended position over a length of the arm in the extended position is no more than 15%.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The gate comprises a control system comprising an actuator and configured to support the arm and move the arm between the extended position and the retracted position. The given portion of the roadway includes a lane. The arm is configured to be longer than a width of the lane in the extended position. The gate is mountable to a traffic barrier for the roadway, and a footprint of the gate on the traffic barrier in a longitudinal direction of the arm in the extended position is no more than 30 inches.

In accordance with another aspect of the disclosure, there is provided a gate for controlling oncoming traffic on a roadway. The gate comprises an arm movable between an extended position in which the arm extends into a given portion of the roadway to inform the oncoming traffic that the given portion of the roadway is closed and a retracted position in which the arm does not extend into the given portion of the roadway. The arm comprises a beam that extends along a longitudinal direction of the arm and a visible arrangement supported by the beam. The visible arrangement comprises a plurality of visible members. A transversal one of the visible members projects from the beam and extends transversally to the longitudinal direction of the beam. A longitudinal one of the visible members extends along the longitudinal direction of the beam. A material of the beam is different from a material of the visible arrangement. The gate comprises a control system comprising an actuator and configured to support the arm and move the arm between the extended position and the retracted position.

These and other aspects of this disclosure will now become apparent to those of ordinary skill in the art upon review of the following description of embodiments in conjunction with the accompanying drawings.

BRIEF DESCRIPTION OF THE DRAWINGS

A detailed description of embodiments is provided below, by way of example only, with reference to the accompanying drawings, in which.

It is to be expressly understood that the description and drawings are only for the purpose of illustrating certain embodiments and are an aid for understanding. They are not intended to be limitative.

DETAILED DESCRIPTION OF EMBODIMENTS

Figure 1:
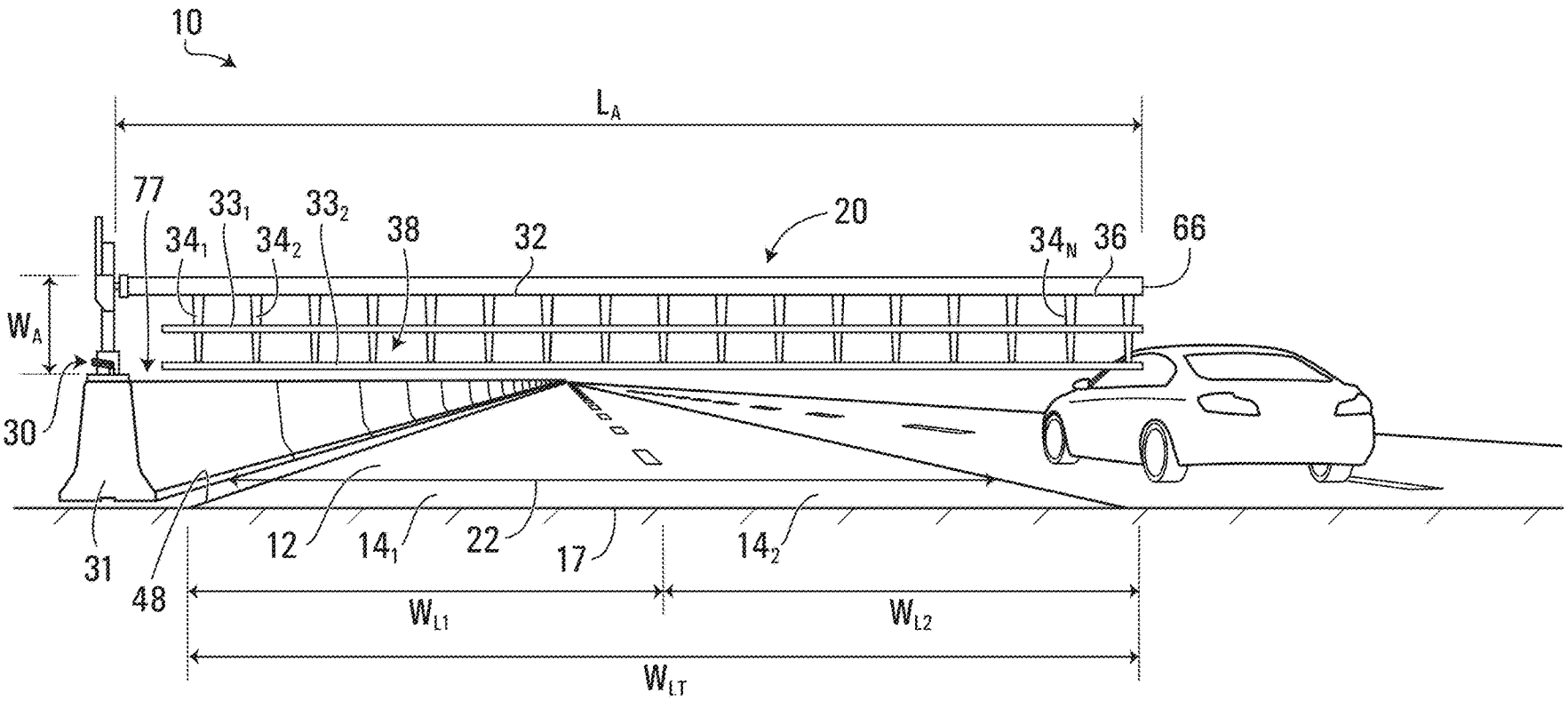
FIG. 1 shows an example of a gate for controlling oncoming traffic on a roadway in accordance with an embodiment, in which an arm of the gate is in an extended position.
Figure 2:
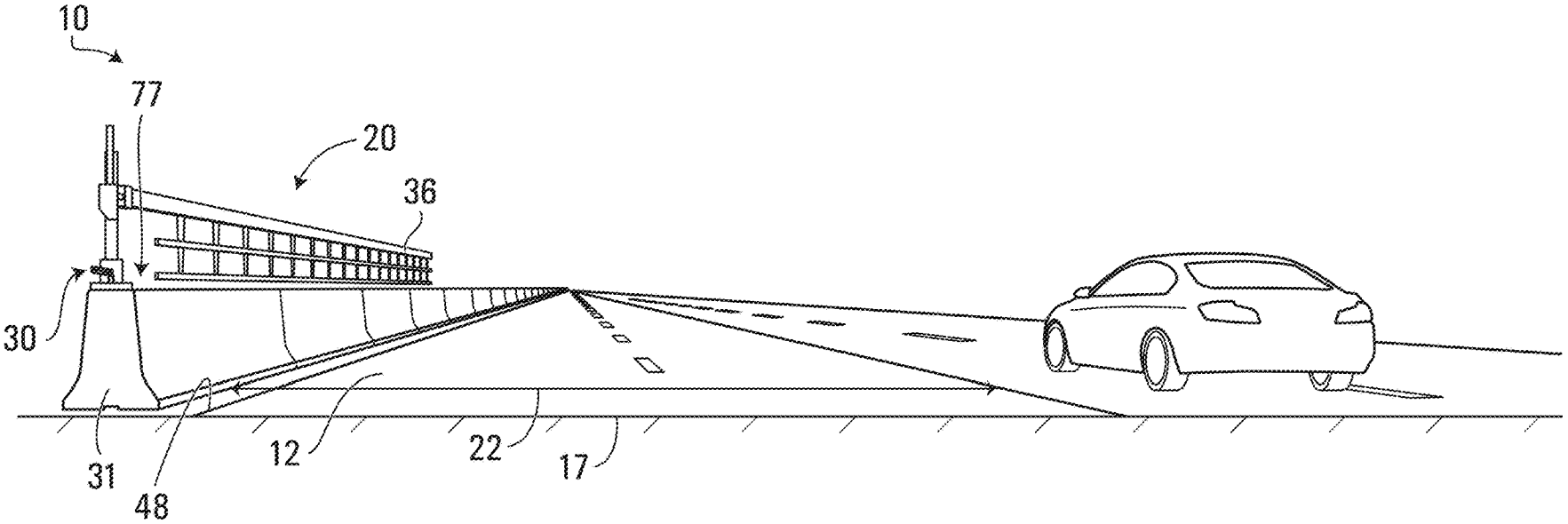
FIG. 2 shows the arm of the gate in a retracted position.

FIGS. 1 and 2 show an example of a gate 10 for controlling oncoming traffic on a roadway 12 in accordance with an embodiment. The gate 10 is configured to inform the oncoming traffic, which may include passenger cars, trucks, and/or other motor vehicles travelling on a surface 17 of the roadway 12, that at least part of the roadway 12 is closed. In this example, unlike resistance gates (also sometimes referred to as "resistance barriers" or "final barriers"), the gate 10 is "forgiving" in that it allows an oncoming vehicle to pass through it if crashed into, i.e., is not designed to stop the oncoming vehicle.

In this embodiment, the gate 10 is used for lane closure, i.e., closing one or more lanes, such as highway lanes, express lanes, high-occupancy toll (HOT) lanes, high-occupancy vehicle (HOV) lanes, and/or other lanes of the roadway 12. In other embodiments, the gate 10 may be used for other traffic control measures, such as ramp access control (e.g., on-ramp or off-ramp access control), tunnel/bridge closure, work-zone lane closure, weather-related access control, etc.

The gate 10 comprises an arm 20 movable between (i) an extended position in which the arm 20 extends into a given portion 22 of the roadway 12 to inform the oncoming traffic that the given portion 22 of the roadway 12 is closed, as shown in FIG. 1, and (ii) a retracted position in which the arm 20 does not extend into the given portion 22 of the roadway 12 and thus leaves open the given portion 22 of the roadway 12 for the oncoming traffic, as shown in FIG. 2. The arm 20 has a longitudinal direction, which defines a length $L_A$ of the arm 20 in its extended position, and a widthwise direction, which is generally vertical and defines a width $W_A$ of the arm 20 in its extended position. The gate 10 also comprises a control system 30 configured to support the arm 20 and move the arm 20 between its extended position and its retracted position. The arm 20 is cantilevered at the control system 30 in its extended position. In this embodiment, the control system 30 is mounted to a traffic barrier 31 for the roadway 12. In this example, the traffic barrier 31 is a median barrier between opposite traffic directions for the roadway 12.

In this embodiment, as further discussed later, the arm 20 may be quite long and vertically wide to close more of the roadway 12 and be clearly visible to the oncoming traffic, while the gate 10 may be crash-tested (i.e., compliant with crash-testing criteria), its control system 30 may be compact, and the gate 10 may be reusable and easily repairable if crashed into.

In this example, the gate 10 is used to close one or more of a plurality of lanes $\mathbf{14}_1$-$\mathbf{14}_L$ of the roadway 12. The given portion 22 of the roadway 12 to be closed by the arm 20 thus includes at least one of the lanes $\mathbf{14}_1$-$\mathbf{14}_L$. In this embodiment, the arm 20 is configured to be longer than a width $W_{Lx}$ of a lane $\mathbf{14}_x$ that it can close in its extended position. More particularly, in this embodiment, the given portion 22 of the roadway 12 to be closed by the arm 20 includes plural ones of the lanes $\mathbf{14}_1$-$\mathbf{14}_L$, namely the lanes $\mathbf{14}_1$, $\mathbf{14}_2$. In this example, the roadway 12 is a highway and the lanes $\mathbf{14}_1$, $\mathbf{14}_2$ that can be closed by the arm 20 are express lanes. In this case, the arm 20 is configured to span the lanes $\mathbf{14}_1$, $\mathbf{14}_2$ in its extended position. That is, the arm 20 is configured to extend at least as long as a total width $W_{LT}$ of the lanes $\mathbf{14}_1$, $\mathbf{14}_2$ (i.e., $W_{L1}+W_{L2}$) in its extended position. Also, in this example, the roadway 12 also includes a shoulder 48, and the given portion 22 of the roadway 12 to be closed by the arm 20 also includes the shoulder 48. In some cases, the roadway 12 may include another shoulder on an opposite side of the roadway 12, and both shoulders may be closed by the arm 20.

The length $L_A$ of the arm 20 in its extended position may thus be significant. For example, in some embodiments, the length $L_A$ of the arm 20 in its extended position may be at least 20 feet (ft) (about 6.1 meters (m)), in some cases at least 25 ft (about 7.6 m), in some cases at least 30 ft (about 9.1 m), in some cases at least 35 ft (about 10.7 m), in some cases at least 40 ft (about 12.2 m), and in some cases even greater. In this example, the length $L_A$ of the arm 20 in its extended position is 30 ft. In this case, the length $L_A$ of the arm 20 in its extended position is at least as long as the total width $W_{LT}$ of the lanes $\mathbf{14}_1$, $\mathbf{14}_2$ (i.e., $L_A \geq W_{L1}+W_{L2}$).

In some embodiments, in order to progressively divert the oncoming traffic away from the lanes $\mathbf{14}_1$, $\mathbf{14}_2$ being closed, a series of other gates similar and shorter than the gate but gradually longer from one to another may be placed along the roadway 12 before the gate 10 (e.g., each of these other gates may be 4 ft, 10 ft, or 15 ft long, or any other length).

The width $W_A$ of the arm 20 in its extended position may also be significant, notably to make the arm 20 clearly visible to the oncoming traffic. For example, in some embodiments, the width $W_A$ of the arm 20 in a vertical direction in its extended position may be at least 15 inches (about 38 cm), in some cases at least 20 inches (about 50 cm), in some cases at least 30 inches (about 76 cm), in some cases at least 40 inches (about 1 m), and in some cases even more.

In some embodiments, the width $W_A$ of the arm 20 may be such that the arm 20 is relatively close to a top 77 of the traffic barrier 31 when the arm 20 is in its retracted position. For instance, in some embodiments, the width $W_A$ of the arm 20 may be such that the arm 20 is within 4 inches, in some cases within 2 inches, and in some cases even closer to the top 77 of the traffic barrier 31 when the arm 20 is in its retracted position.

The width $W_A$ of the arm 20 which may be significant for visibility of the arm 20 to the oncoming traffic can also be expressed in relation to the height $L_A$ of the arm 20. For example, in some embodiments, a ratio of the width $W_A$ of the arm 20 in its extended position over the length $L_A$ of the arm 20 in its extended position may be at least 5%, in some cases at least 8%, in some cases at least 10%, in some cases at least 15%, and in some cases even more.

Figure 3:
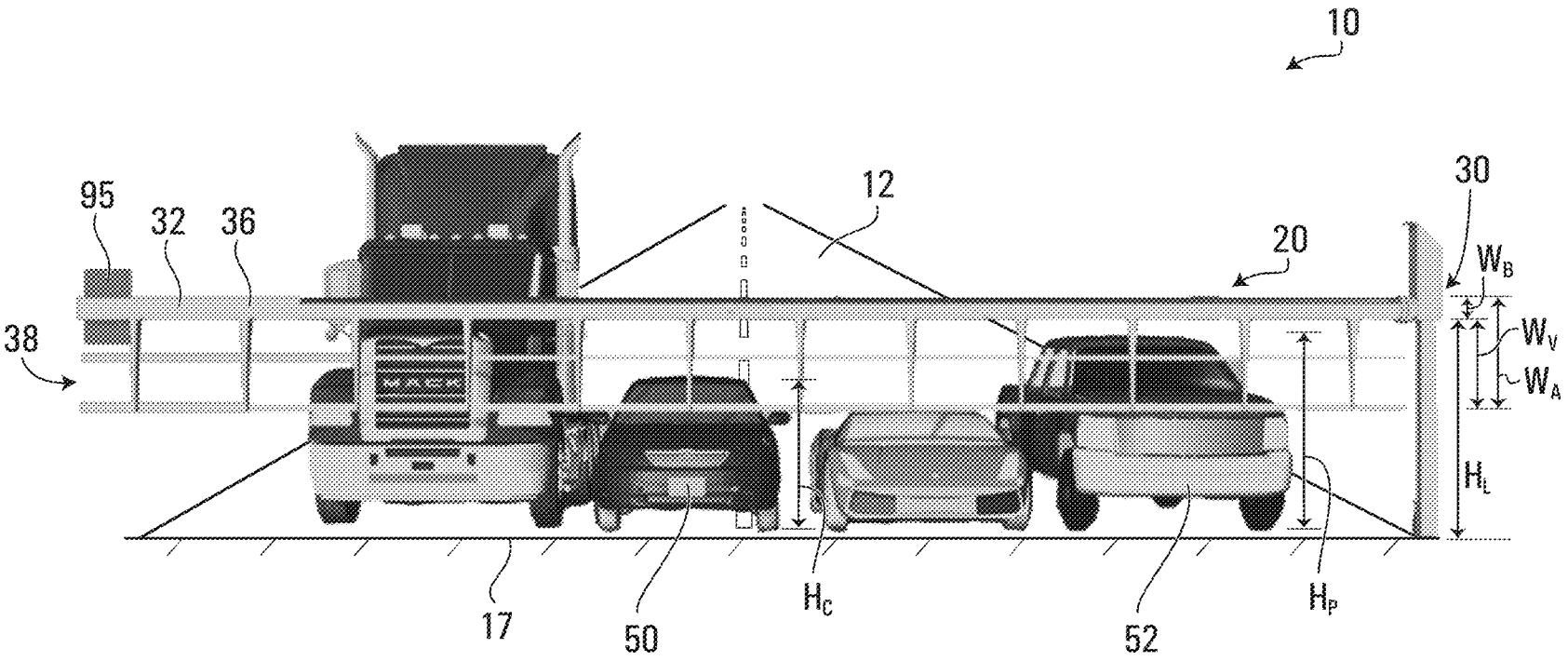
FIGS. 3 and 4 show the gate in relation to vehicles.
Figure 4:
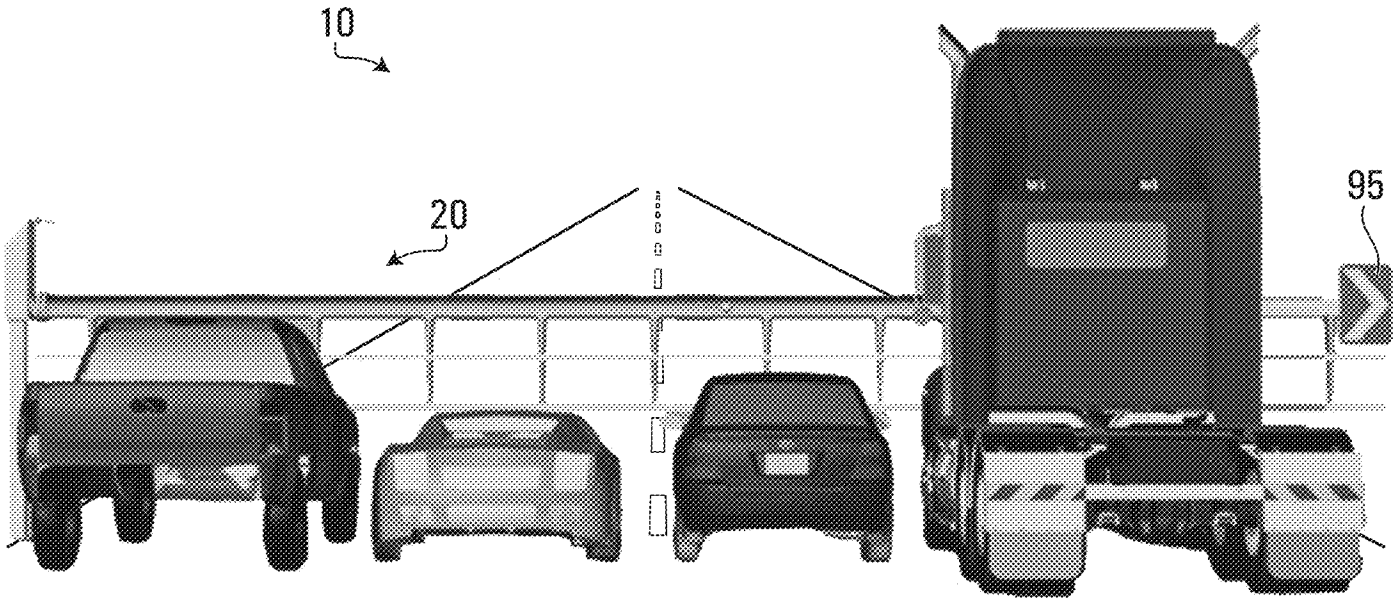
Figure 5:
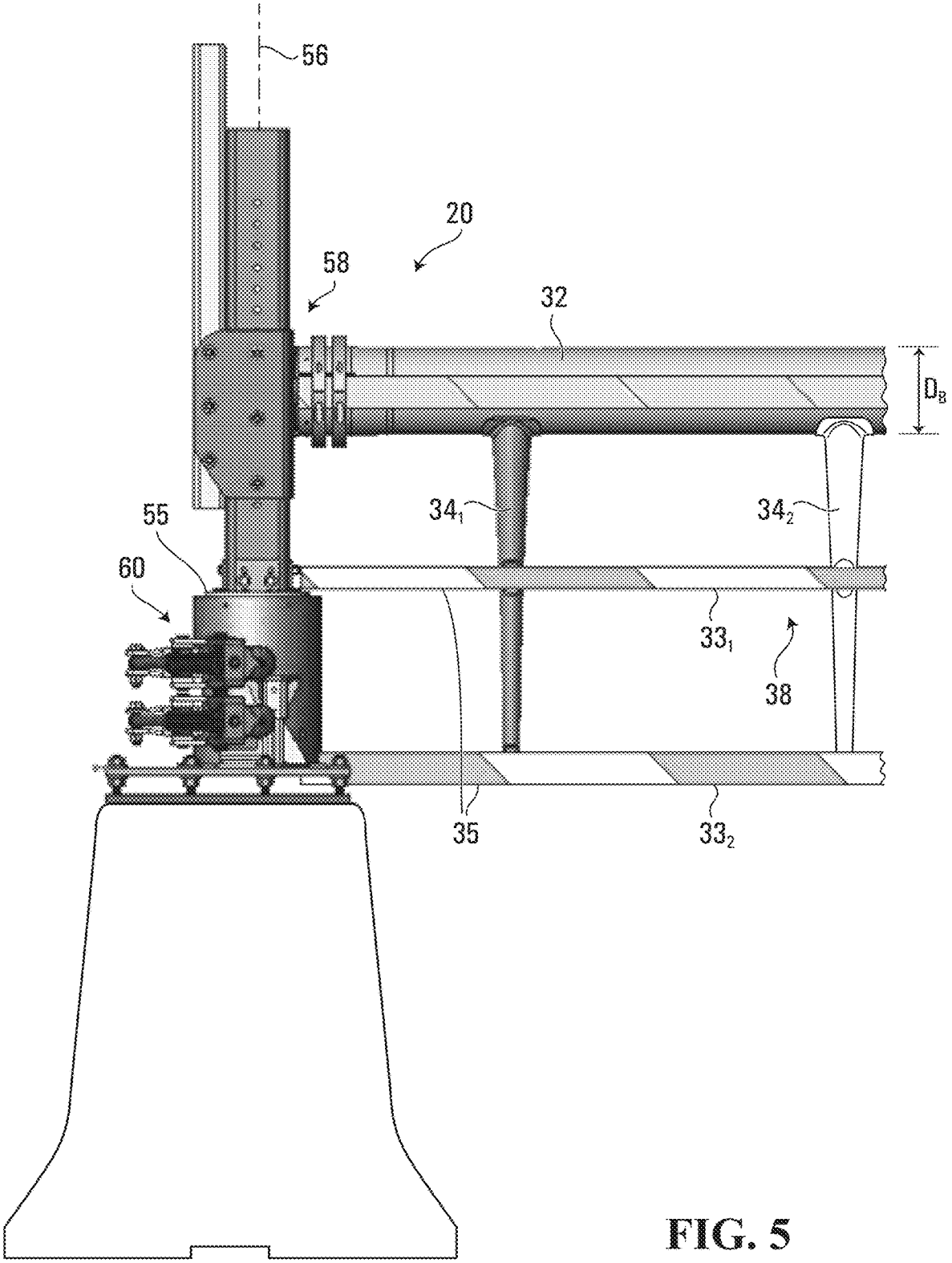
FIGS. 5 and 6 show part of a control system of the gate.
Figure 6:
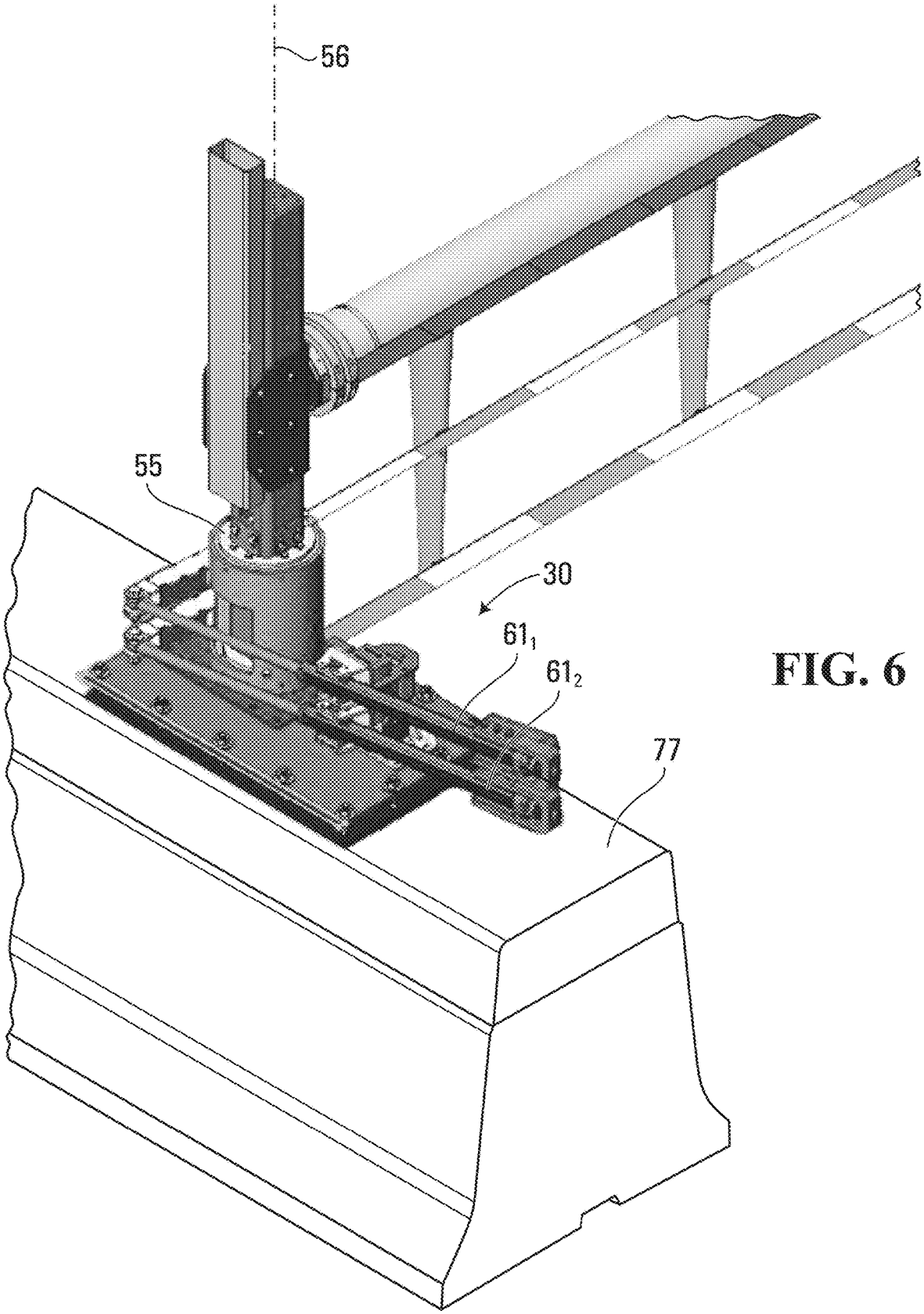
Figure 7:
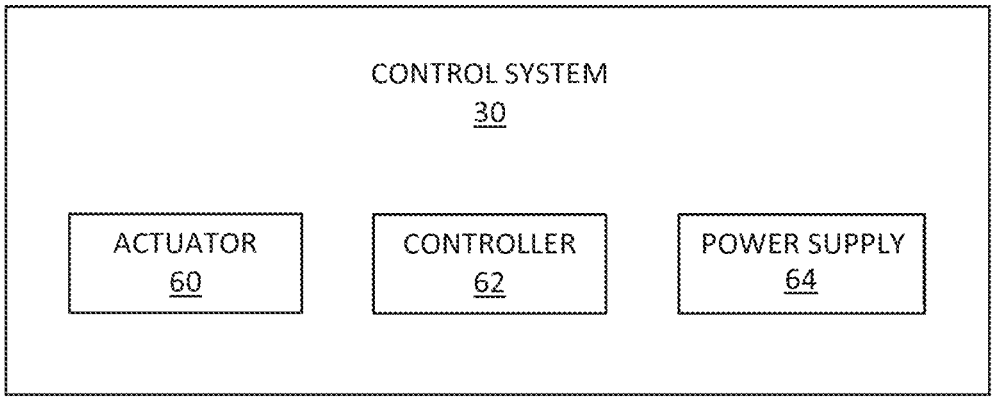
FIGS. 7 to 9 show block diagrams illustrating components of the control system.

With additional reference to FIGS. 3 and 4, in this embodiment, a longitudinal part 36 of the arm 20 in its extended position may be located relatively high with respect to the surface 17 of the roadway 12. This may help the gate 10 to be crashworthy. For instance, this may allow positioning what imparts structural integrity of the arm 20 sufficiently high to clear vehicles (e.g., passenger cars and pickup trucks) that would crash into the gate 10. This may be particularly useful given that the arm 20 may be quite long and vertically wide (e.g., the longitudinal part 36 of the arm 20 may be stiff in order for the arm 20 to stay straight, and so placing it high may help the gate 10 to be crashworthy).

For example, in some embodiments, a height $H_L$ of the longitudinal part 36 of the arm in its extended position from the surface 17 of the roadway 12 may be at least 55 inches (about 1.4 m), in some cases at least 60 inches (about 1.5 m), in some cases at least 65 inches (about 1.65 m), in some cases at least 70 inches (about 1.8 m), in some cases at least 75 inches (about 1.9 m), and in some cases even more (e.g., up to 14 ft).

The width $W_A$ of the arm 20 which may be significant for visibility of the arm 20 to the oncoming traffic can also be expressed in relation to the height $H_L$ of the longitudinal part 36 of the arm 20 from the surface 17 of the roadway 12. For instance, in some embodiments, a ratio of the width $W_A$ of the arm 20 in its extended position over the height $H_L$ of the longitudinal part 36 of the arm 20 in its extended position from the surface 17 of the roadway 12 may be at least 0.2, in some cases at least 0.4, in some cases at least 0.6, and in some cases even more.

In this embodiment, the gate 10 is crash-tested, i.e., compliant with crash-testing criteria. More particularly, in this embodiment, the gate 10 is MASH crash-tested, i.e., compliant with crash-testing criteria of MASH, which is the Manual for Assessing Safety Hardware produced by the American Association of State Highway and Transportation Officials (AASHTO), published as a $2^{nd}$ edition in 2016, accessible at https://bookstore.transportation.org/, and incorporated by reference herein.

For example, in some embodiments, the gate 10 may be compliant with (i.e., be able to successfully pass all) MASH evaluation criteria of Test Level 3 Support Structures test matrices and/or MASH evaluation criteria of Test Level 3 Work Zone Traffic Control Devices test matrices.

As may be better seen in FIGS. 3 and 4, in this embodiment, the height $H_L$ of the longitudinal part 36 of the arm 20 from the surface 17 of the roadway 12 is greater than a height $H_c$ of a passenger car 50 complying with MASH crash-testing. More particularly, in this embodiment, the height $H_L$ of the longitudinal part 36 of the arm 20 from the surface 17 of the roadway 12 is no less than a height $H_p$ of a pickup truck 52 complying with MASH crash-testing. In this case, the height $H_L$ of the longitudinal part 36 of the arm 20 from the surface 17 of the roadway 12 is greater than the height $H_p$ of the pickup truck 52 complying with MASH crash-testing.

The arm 20 may be constructed in any suitable way. In this embodiment, the arm 20 comprises a beam 32 extending along the longitudinal direction of the arm 20 and a visible arrangement 38 supported by the beam 32.

In this embodiment, the beam 32 provides the structural integrity of the arm 20 and comprises the longitudinal part 36 of the arm 20 significantly elevated relative to the surface 17 of the roadway 12. In this example, the beam 32 is a sole beam of the arm 20. That is, the arm 20 is free of (i.e., without) any other beam that extends along its longitudinal direction for its structural integrity.

The beam 32 may include any suitable material. In this embodiment, the beam 32 comprises a metallic material. More particularly, in this embodiment, the metallic material of the beam 32 is aluminum. The beam 32 may include any other suitable metallic material (e.g., steel) and/or any other nonmetallic material (e.g., polymeric material, including fiber-reinforced polymeric material, such as carbon-fiber-reinforced polymeric material) in other embodiments.

Also, the beam 32 may have any suitable cross-sectional shape. In this embodiment, the beam 32 has a circular cross-section. Also, in this embodiment, the beam 32 is hollow, i.e., comprises an internal cavity, to help reduce a weight of the beam 32 and thus a weight of the arm 20. In other embodiments, the beam 32 may have any other cross-section instead of or in addition to a circular one, such as another curved cross-section, a polygonal (e.g., rectangular, pentagonal, hexagonal, heptagonal, octagonal, etc.) cross-section, a U-shape cross-section, an H-shape cross-section, a T-shape cross-section, a V-shape cross-section, any other standard beam cross-sectional shape, a custom shape, etc.

In this embodiment, considering that it provides the structural integrity of the arm 20, the beam 32 is dimensioned to make the arm 20 strong and stiff enough to support its weight (e.g., and possibly other loading from snow, ice or other matter which may rest upon it) in its extended position without excessively deflecting, yet be light enough for operation by the control system 30 gate. For instance, in some embodiments, a cross-sectional dimension DB of the beam 32 may be no more than 12 inches, in some cases no more than 10 inches, in some cases no more than 8 inches, in some cases no more than 6 inches, in some cases no more than 4 inches, and in some cases even less (e.g., 2 inches). In this example where the cross-section of the beam 32 is circular, the cross-sectional dimension DB of the beam 32 is a diameter of the beam 32.

The visible arrangement 38 increases the visibility of the arm 20 to the oncoming traffic. In this embodiment, the visible arrangement 38 depends downwardly from the beam 32. In this example, the visible arrangement 38 is disruptable, i.e., deflectable or breakable, if crashed into by an oncoming vehicle without significantly damaging the oncoming vehicle. For instance, in this embodiment, disruption of the visible arrangement 38 by the oncoming vehicle avoids damaging the oncoming vehicle beyond what is permitted under MASH crash-testing (e.g., MASH windshield criteria regarding no tear of a plastic liner of the oncoming vehicle's windshield and a maximum deformation of 3 inches (76 mm), or MASH criteria regarding no detached elements, fragments or other debris from the visible arrangement and/or vehicular damage blocking the driver's vision or otherwise causing the driver to lose control of the vehicle).

More particularly, in this embodiment, a dimension $W_V$ of the visible arrangement 38 in the widthwise direction of the arm 20 is greater than a dimension $W_B$ of the beam 32 in the widthwise direction of the arm 20. For example, in some embodiments, the dimension $W_V$ of the visible arrangement 38 in the widthwise direction of the arm 20 may be at least twice, in some cases at least thrice, and in some cases more than thrice the dimension $W_B$ of the beam 32 in the widthwise direction of the arm 20. In this example, the dimension $W_V$ of the visible arrangement 38 in the widthwise direction of the arm 20 is about four times the dimension $W_B$ of the beam 32 in the widthwise direction of the arm 20.

Also, in this embodiment, the dimension $W_V$ of the visible arrangement 38 in the widthwise direction of the arm 20 corresponds to at least a majority of the dimension $W_A$ of the arm 20. For instance, in some embodiments, the dimension $W_V$ of the visible arrangement 38 in the widthwise direction of the arm 20 may correspond to at least half, in some cases at least two-thirds, in some cases at least three-quarters, and in some cases at least four-fifths of the dimension $W_A$ of the arm 20.

The visible arrangement 38 may be implemented in any suitable way. In this embodiment, the visible arrangement 38 comprises a plurality of visible members $33_1$, $33_2$, $34_1$-$34_{12}$. More particularly, in this embodiment, transversal ones of the visible members $33_1$, $33_2$, $34_1$-$34_{12}$, namely the transversal visible members $34_1$-$34_{12}$, project from the beam 32, extend transversally to the longitudinal direction of the beam 32 and are spaced apart in the longitudinal direction of the beam 32, whereas longitudinal ones of the visible members $33_1$, $33_2$, $34_1$-$34_{12}$, namely the longitudinal visible members $33_1$, $33_2$, extend and are elongated in the longitudinal direction of the beam 32 and are spaced apart in the widthwise direction of the beam 32.

In this embodiment, the transversal visible members $34_1$-$34_{12}$ depend downwardly from the beam 32. More particularly, in this embodiment, the transversal visible members $34_1$-$34_{12}$ extend substantially perpendicularly to the longitudinal direction of the beam 32. In this example, each of the transversal visible members $34_1$-$34_{12}$ comprises a post 34. The transversal visible members $34_1$-$34_{12}$ may be shaped in any other suitable way and/or different ones of the transversal visible members $34_1$-$34_{12}$ may be shaped differently in other embodiments.

Also, in this embodiment, the longitudinal visible members $33_1$, $33_2$ extend generally parallel to the longitudinal direction of the beam 32. The longitudinal visible members $33_1$, $33_2$ are reflective so that light reflects on them to increase the visibility of the visible arrangement 38 to the oncoming traffic. Any suitable reflective material may be used. In this example, each of the longitudinal visible members $33_1$, $33_2$ comprises a strip 35. The strip 35 may be flexible so that it can deflect easily if an oncoming vehicle crashes into the gate 10. In some cases, the strip 35 may be a one-piece strip. In other cases, the strip 35 may include a plurality of pieces that constitute longitudinally-extending segments and are interconnected. This may facilitate transportation, handling and installation at the roadway 12. The longitudinal visible members $33_1$, $33_2$ may be shaped in any other suitable way and/or different ones of the longitudinal visible members $33_1$, $33_2$ may be shaped differently in other embodiments.

In this embodiment, the visible arrangement 38 comprises one or more polymeric materials. More particularly, in this embodiment, the transversal visible members $34_1$-$34_{12}$ comprise a polymeric material (e.g., high-density polyethylene) and the longitudinal visible members $33_1$, $33_2$ comprises a different polymeric material (e.g., polycarbonate with a reflective layer, such as high-intensity retroreflective sheeting). Any other suitable material may be used for the visible arrangement 38 in other embodiments (e.g., any other polymeric material, composite material, etc. with high impact strength and high plastic deformation to bend instead of breaking upon impact).

The beam 32 and the visible arrangement 38 may be interconnected in any suitable way. In this embodiment, the transversal visible members $34_1$-$34_{12}$ are affixed to and extend downwardly from the beam 32, while the longitudinal visible members $33_1$, $33_2$ are affixed to and extend across respective ones of the transversal visible members $34_1$-$34_{12}$. Also, in this embodiment, at least part of the visible arrangement 38 may be easily replaceable without having to dismantle or replacing entirely the arm 20 when the gate 10 is crashed into (e.g., by a passenger car or pickup truck).

In this embodiment, the visible arrangement 38, including respective ones of the transversal visible members $34_1$-$34_{12}$, is fastened to the beam 32 by one or more mechanical fasteners, such as rivets, bolts, screws or other threaded fasteners, or any other suitable mechanical fasteners (e.g., compression clamps). Alternatively or additionally, in some embodiments, the visible arrangement 38 may be bonded to an external surface of the beam 32 by an adhesive (e.g., an acrylic, epoxy, urethane, elastomer, silicone, cyanoacrylate, etc.), ultrasonic welding or any other suitable bonding.

Also, in this embodiment, the longitudinal visible members $33_1$, $33_2$ may be secured to respective ones of the transversal visible members $34_1$-$34_{12}$ by one or more mechanical fasteners, such as rivets, bolts, screws or other threaded fasteners, or any other suitable mechanical fasteners. As an alternative or in addition, in some embodiments, the longitudinal visible members $33_1$, $33_2$ may be bonded to respective ones of the transversal visible members $34_1$-$34_{12}$ by an adhesive (e.g., an acrylic, epoxy, urethane, elastomer, silicone, cyanoacrylate, etc.), ultrasonic welding or any other suitable bonding.

The beam 32 and the visible arrangement 38 may thus be made of different materials with different properties. This may help for allowing the beam 20 to be long and vertically wide, yet support it at the control system 30 and enable the gate 10 to be crash-tested. For instance, in this embodiment, the beam 32 includes a metallic material and each of the visible members $33_1$, $33_2$, $34_1$-$34_{12}$ includes a polymeric material.

For example, in some embodiments, a material of the beam 32 (e.g., in this case, metallic material) may be denser than a material of the visible arrangement 38 (e.g., in this case, polymeric material), such as a material of each of the visible members $33_1$, $33_2$, $34_1$-$34_{12}$. More particularly, in some embodiments, a ratio of a density of the material of the beam 32 over a density of the material of the visible arrangement 38 (e.g., a density of the material of each of the visible members $33_1$, $33_2$, $34_1$-$34_{12}$) may be at least 1.2, in some cases at least 1.5, in some cases at least 2, in some cases at least 4, and in some cases even more.

Also, in some embodiments, the beam 32 may be stiffer than the visible arrangement 38 in a direction of the oncoming traffic. For instance, a material of the beam 32 (e.g., in this case, metallic material) may be stiffer than a material of the visible arrangement 38 (e.g., in this case, polymeric material), such as a material of each of the visible members $33_1$, $33_2$, $34_1$-$34_{12}$. For example, in some embodiments, a ratio of a modulus of elasticity (i.e., Young's modulus) of the material of the beam 32 over a modulus of elasticity of the material of the visible arrangement 38 (e.g., a modulus of elasticity of the material of each of the visible members $33_1$, $33_2$, $34_1$-$34_{12}$) may be at least 5, in some cases at least 10, in some cases at least 20, in some cases at least 50, in some cases at least 100, and in some cases even more.

Figure 28A:
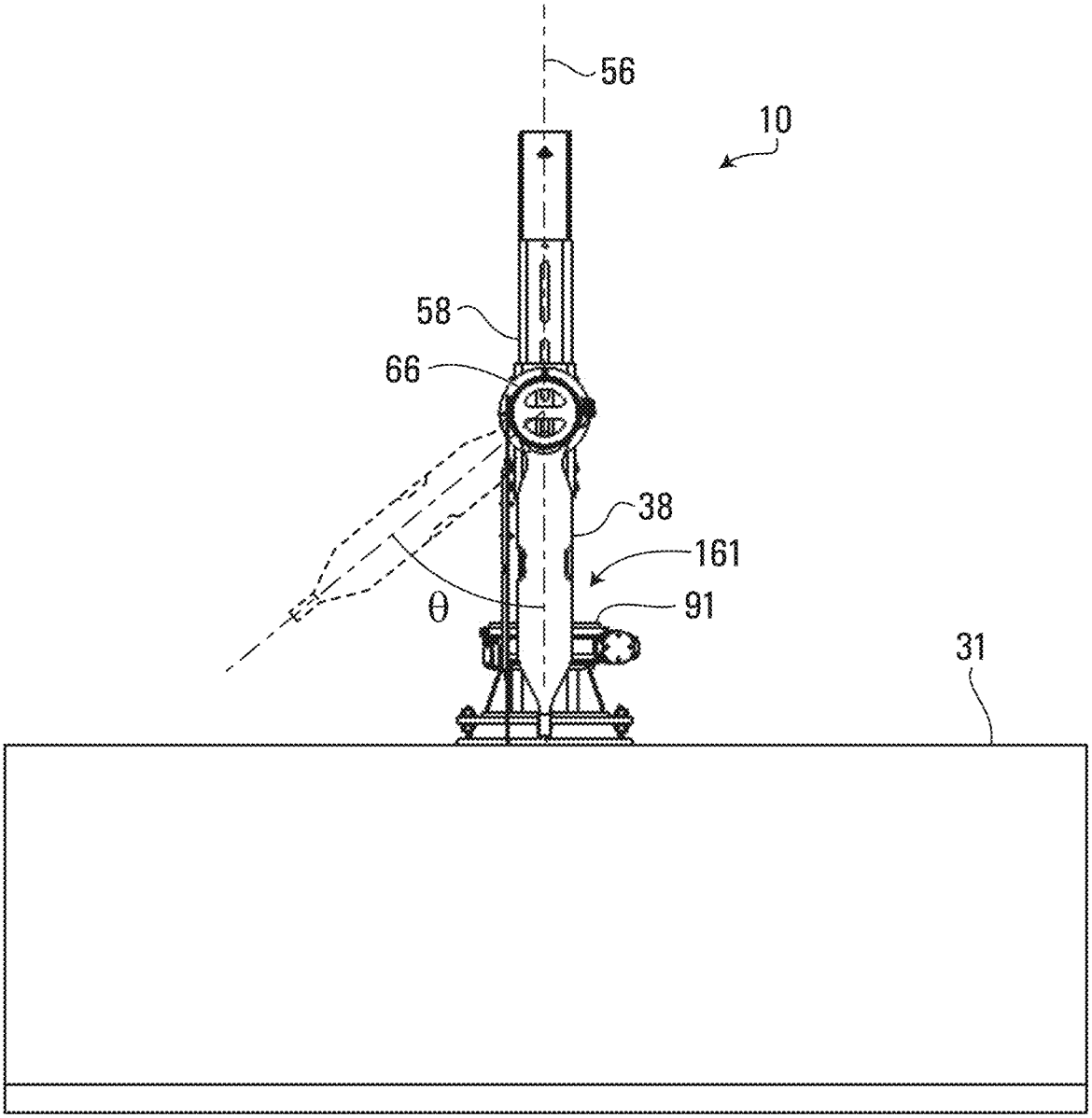
FIGS. 28A and 28B show examples of deflections of the arm about a horizontal axis and a vertical axis.
Figure 28B:
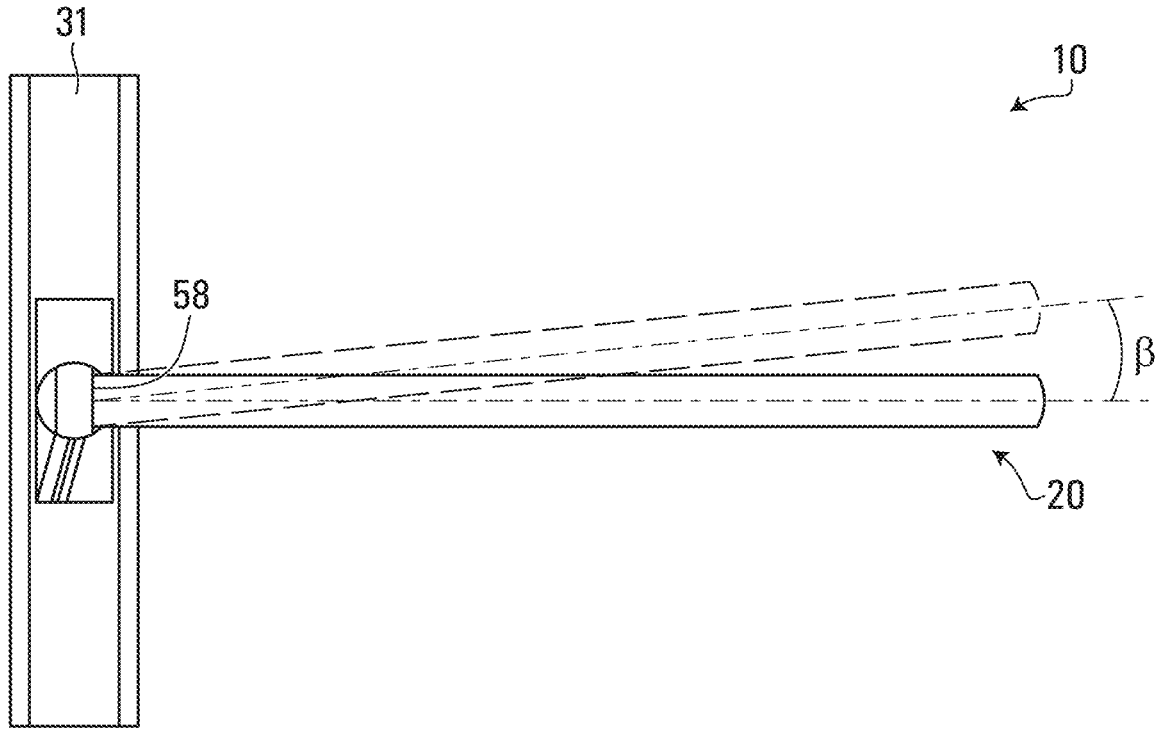

In this embodiment, the arm 20, including its visible arrangement 38, is configured to prevent excessive wind deflection, i.e., deflection of the arm 20, including its visible arrangement 38, due to wind. That is, the arm 20, including its visible arrangement 38, is constructed such that it does not excessively deflect due to wind that can be encountered normally at the roadway 12. For example, in some embodiments, as shown in FIG. 28, a deflection $\theta$ of the arm 20, and thus of its visible arrangement 38, (measured based on a free longitudinal edge 66 of the arm 20, which in this case is part of the visible arrangement 38, relative to a vertical direction about a horizontal axis when there is no wind) at a wind speed of 100 km/h may be no more than 15°, in some cases no more than 10°, in some cases no more than 5°, and in some cases even less (e.g., 0°, i.e., zero deflection such that the visible arrangement 38 stays exactly in place). As another example, in some embodiments, a deflection $\beta$ of the arm 20, and thus of its visible arrangement 38, (measured based on a distal end of the arm 20, about a vertical axis when there is no wind) at a wind speed of 100 km/h may be no more than 15°, in some cases no more than 10°, in some cases no more than 5°, and in some cases even less (e.g., 0°, i.e., zero deflection such that the arm 20 stays exactly in place).

The control system 30 is configured to support and move the arm 20 between its extended position and its retracted position in order to selectively close and leave open the lanes $\mathbf{14}_1$, $\mathbf{14}_2$. In this embodiment, the control system 30 is configured such that the arm 20 is movable horizontally relative to the control system 30 between its extended position and its retracted position.

With additional reference to FIGS. 5 to 7, 48 and 49, the control system 30 comprises an actuator 60 for moving the arm 20 between its extended position and its retracted position. In this embodiment, the actuator 60 is configured to cause pivoting of the arm between its extended position and its retracted position about a pivot 55 having a pivot axis 56. In this example, the control system 30 comprises a support 58 carrying the arm 20 and implementing the pivot 55. Upon actuation by the actuator 60, the arm is pivotable about the pivot 55 between its extended position and its retracted position.

In this embodiment, the actuator 60 comprises a linear actuator. More particularly, in this embodiment, the actuator 60 comprises an electromechanical linear actuator. In this example, the actuator 60 comprises a plurality of linear actuating members $\mathbf{61}_1$, $\mathbf{61}_2$ that are operative to pivot the arm 20 about the pivot axis 56. In other embodiments, the actuator 60 may be implemented in any other suitable way. For instance, in other embodiments, the actuator 60 may comprise a fluidic actuator, such as a hydraulic or pneumatic actuator, or may comprise a motor, such as an electric motor, or other rotary actuator.

Figure 8:
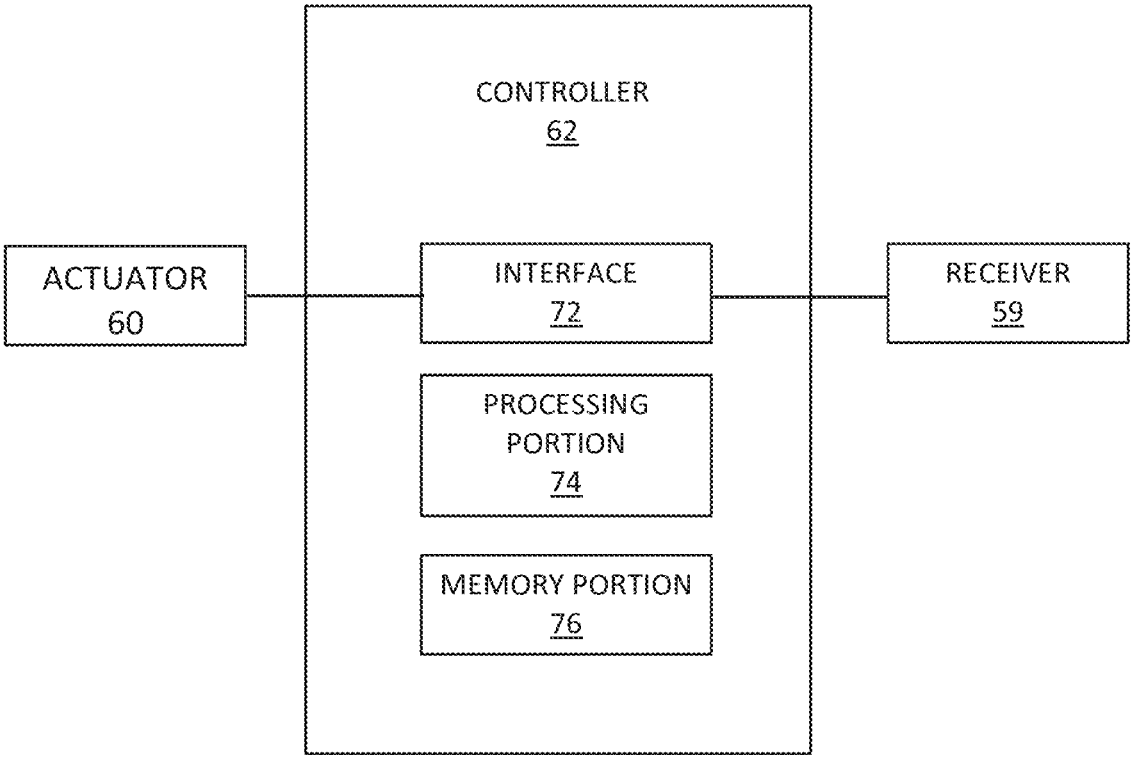
Figure 9:
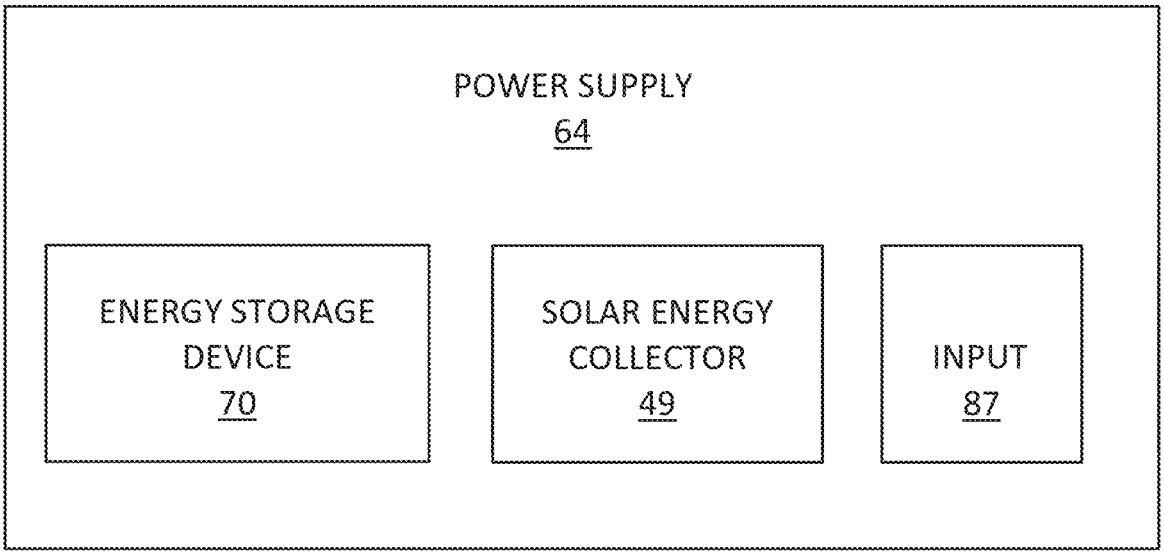

More particularly, in this embodiment, referring additionally to FIGS. 8 and 9, the control system 30 comprises a power supply 64 for providing power to the gate 10 and a controller 62 for controlling operation of the actuator 60 in order to automatically move the arm 20 between its extended position and its retracted position.

In this embodiment, the power supply 64 comprises an input 87 electrically connectable to a power grid to be electrically powered by the power grid for operation of the gate 10, including the actuator 60 and the controller 62 of the control system 30. Also, in this embodiment, the power supply 64 comprises an energy storage device 70 that stores energy for operation of the gate 10 (e.g., in case of a failure or other problem precluding power to be received from the power grid). In this example, the energy storage device 70 comprises a battery. Also, in some cases, the control system 30 may be solar-powered in that the energy storage device 70 may store energy derived from sunlight. The power supply 64 may thus comprise a solar energy collector 49 to collect the sunlight and convert it into electrical energy stored in the energy storage device 70. For instance, the solar energy collector 49 may comprise a solar panel that may comprise a plurality of photovoltaic cells. In other examples, the energy storage device 70 may be implemented in any other suitable way (e.g., comprise a capacitor instead of or in addition to a battery). In other embodiments, the control system 30 may be powered in any other suitable manner (e.g., by being solely electrically connected to the power grid without having the energy storage device 70, or by being solely powered by the energy storage device 70 without being connected to the power grid).

The controller 62 comprises suitable hardware and/or software implementing an interface 72, a processing portion 74, and a memory portion 76 to control operation of the gate 10.

The interface 72 comprises one or more inputs and outputs allowing the controller 62 to receive input signals from and send output signals to other components to which the controller 62 is connected (i.e., directly or indirectly connected). For example, in some embodiments, an input of the interface 72 may be implemented by a receiver 59 of the control system 30 to receive a signal from a remote location (e.g., a traffic management center, a remote control device) to move the arm 20 in order to close or open the lanes $\mathbf{14}_1$, $\mathbf{14}_2$. In some embodiments, the receiver 59 may be configured to wirelessly receive the signal over a wireless link (e.g., implemented by an industrial, scientific and medical (ISM) radio band, a cellular network, a wireless local area network (WLAN), etc.). In other embodiments, the receiver 59 may be configured to receive the signal over a wire (e.g., cable). An output of the interface 72 may be implemented by a transmitter to transmit a signal to the actuator 60.

The processing portion 74 comprises one or more processors for performing processing operations that implement functionality of the controller 62. A processor of the processing portion 74 may be a general-purpose processor executing program code stored in the memory portion 76. Alternatively, a processor of the processing portion 74 may be a specific-purpose processor comprising one or more preprogrammed hardware or firmware elements (e.g., application-specific integrated circuits (ASICs), electrically erasable programmable read-only memories (EEPROMs), etc.) or other related elements.

The memory portion 76 comprises one or more memories for storing program code executed by the processing portion 74 and/or data used during operation of the processing portion 74. A memory of the memory portion 76 may be a semiconductor medium (including, e.g., a solid-state memory), a magnetic storage medium, an optical storage medium, and/or any other suitable type of memory. A memory of the memory portion 76 may be read-only memory (ROM) and/or random-access memory (RAM), for example.

A footprint of the gate 10 on the median barrier 31 to which it is mounted may be relatively small. This may facilitate installation of the gate 10 on existing road infrastructures.

For example, in some embodiments, the footprint of the gate 10 on the median barrier 31 in the longitudinal direction of the arm 20 in its extended position may be no more than 30 inches, in some cases no more than 25 inches, in some cases no more than 20 inches, in some cases no more than 15 inches, in some cases no more than 10 inches, and in some cases even less. For instance, in some examples, the footprint of the gate on the median barrier 31 may be narrower than the median barrier 31 where the control system 30 is mounted, i.e., narrower than a width $W_{BA}$ of the median barrier 31 where the control system 30 is mounted.

To that end, in this embodiment, the control system 30 may be quite compact. For example, in some embodiments, the control system 30 may be narrow in the longitudinal direction of the arm 20 in its extended position. For instance, in some embodiments, a ratio of a dimension We of the control system 30 in the longitudinal direction of the arm 20 in its extended position over the length $L_A$ of the arm 20 in its extended position may be no more than 15%, in some cases no more than 10%, in some cases no more than 5%, and in some cases even less.

In some embodiments, a portion of the median barrier 31 to which the control system 30 is mounted may be wider than an adjacent portion of the median barrier 31 that precedes or follows the portion of the median barrier 31 to which the control system 30 is mounted. That is, the width $W_{BA}$ of the median barrier 31 where the control system 30 is located may be smaller than the width $W_{BA}$ of the median barrier 31 where the control system 30 is not located. This may facilitate accommodating the gate 10 while allowing other parts of the median barrier 31 to be narrower.

The gate 10 may facilitate its installation at the roadway 12 and be reusable and easily repairable if crashed into.

Figure 10:
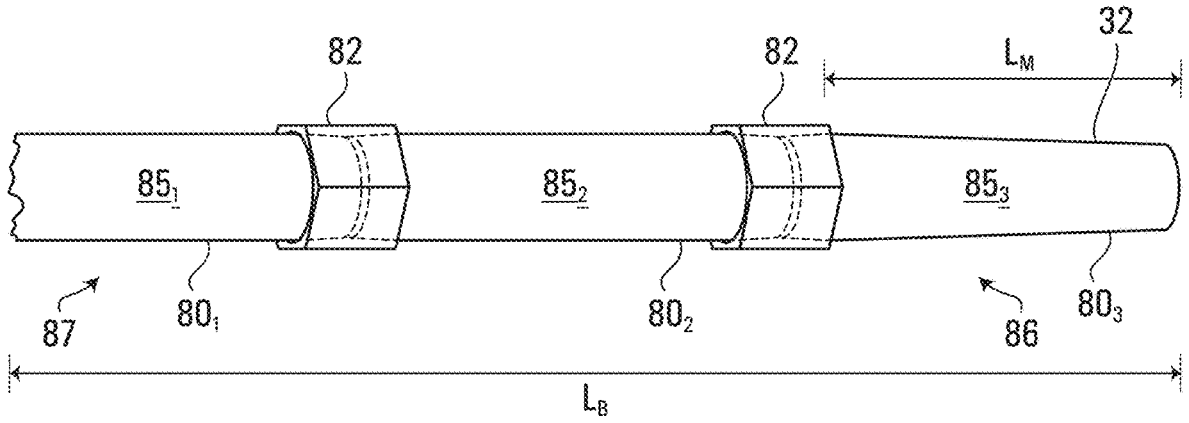
FIGS. 10 and 11 show an example of an embodiment in which a beam of the arm comprises beam segments that are interconnected.

For example, with additional reference to FIG. 10, in some embodiments, the beam 32 may comprise a plurality of beam segments $\mathbf{80}_1$-$\mathbf{80}_M$ that are separate and interconnectable for assembling the beam 32. For instance, each of the beam segments $\mathbf{80}_1$-$\mathbf{80}_M$ may be sized to facilitate its transportation, handling and assembly into the arm 20 to be installed at the roadway 12. As an example, in some embodiments, a length $L_M$ of each of one or more of the beam segments $\mathbf{80}_1$-$\mathbf{80}_M$ may be no more than half, in some cases no more than 40%, in some cases no more than 30%, in some cases no more than 20%, and in some cases even a smaller fraction of a length $L_B$ of the beam 32.

Figure 11:
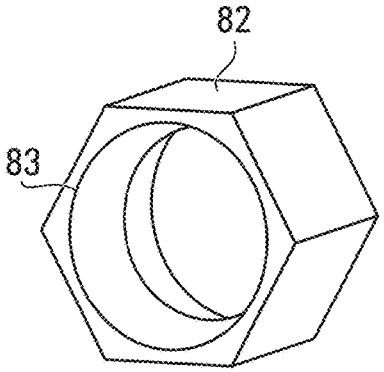

With reference to FIGS. 10 and 11, adjacent ones of the beam segments $\mathbf{80}_1$-$\mathbf{80}_M$ may be interconnected by a connector 82. The connector 82 may be implemented in any suitable way. For example, in some embodiments, the connector 82 may comprise a hollow space 83 (e.g. a circular or other sleeve) configured to slidably engage an end of each of adjacent ones of the beam segments $\mathbf{80}_1$-$\mathbf{80}_M$. A mechanical fastener or an adhesive may then be used to fasten or bond the connector 82 to each of the adjacent ones of the beam segments $\mathbf{80}_1$-$\mathbf{80}_M$ (i.e. end-to-end assembly). In other embodiments, the connector 82 may also comprise a clamp (e.g. clamp ring, clamp sleeve, or any other suitable compression attachment device) for receiving and removably securing an end of each of adjacent ones of the beam segments $\mathbf{80}_1$-$\mathbf{80}_M$ end-to-end. As such, each of adjacent ones of the beam segments $\mathbf{80}_1$-$\mathbf{80}_M$ are compressively secured (i.e., clamped) together. In addition to, or instead of, being compressively secured, the connector 82 may be further secured to each of adjacent ones of the beam segments $\mathbf{80}_1$-$\mathbf{80}_M$ by one or more mechanical fasteners (e.g., a bolt, screw, rivet, etc.).

Figure 39:
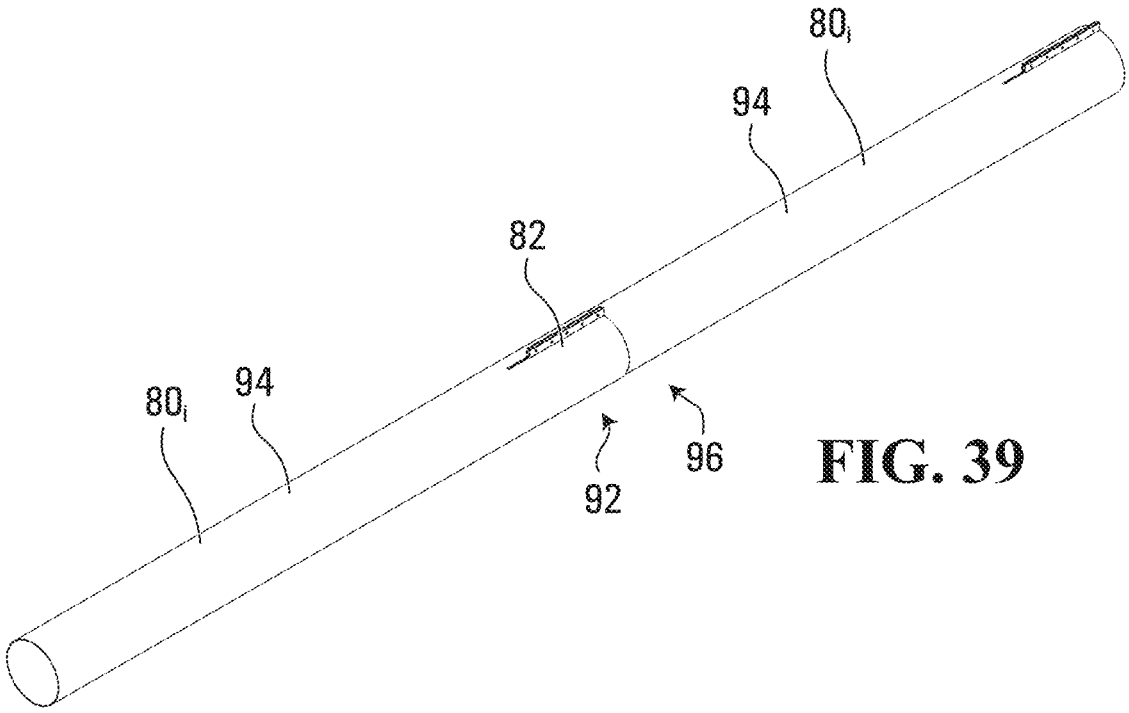
FIGS. 39 to 42 show examples of connectors interconnecting adjacent beam segments of the beam in other embodiments.
Figure 40:
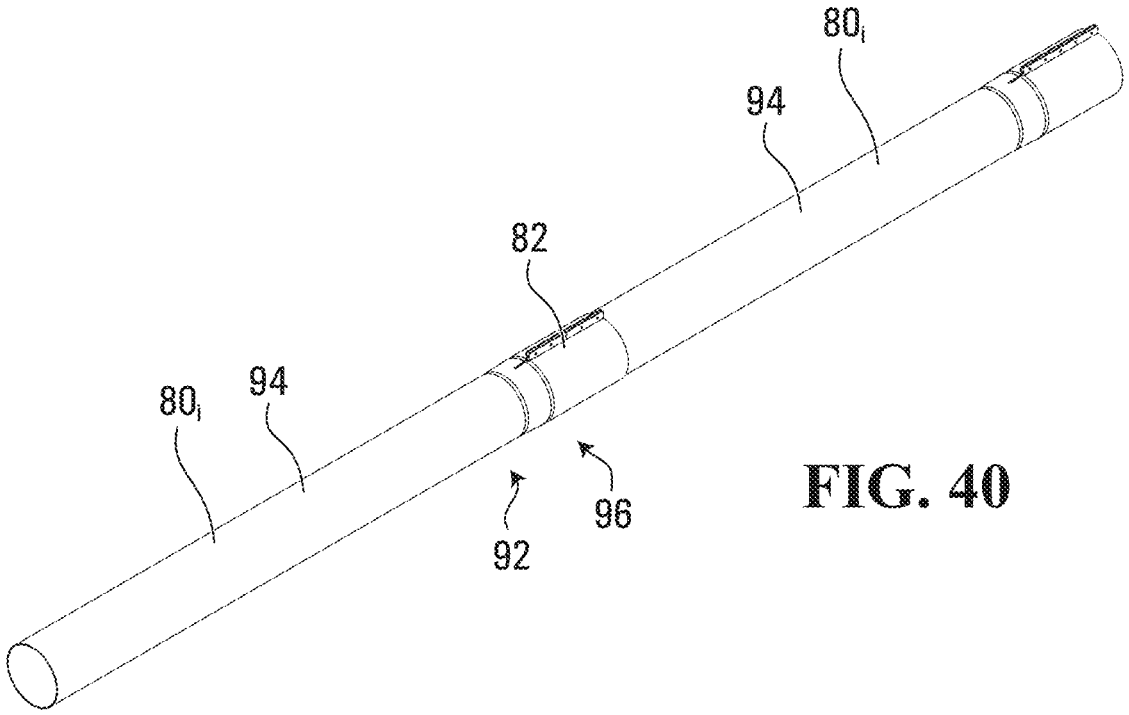
Figure 41:
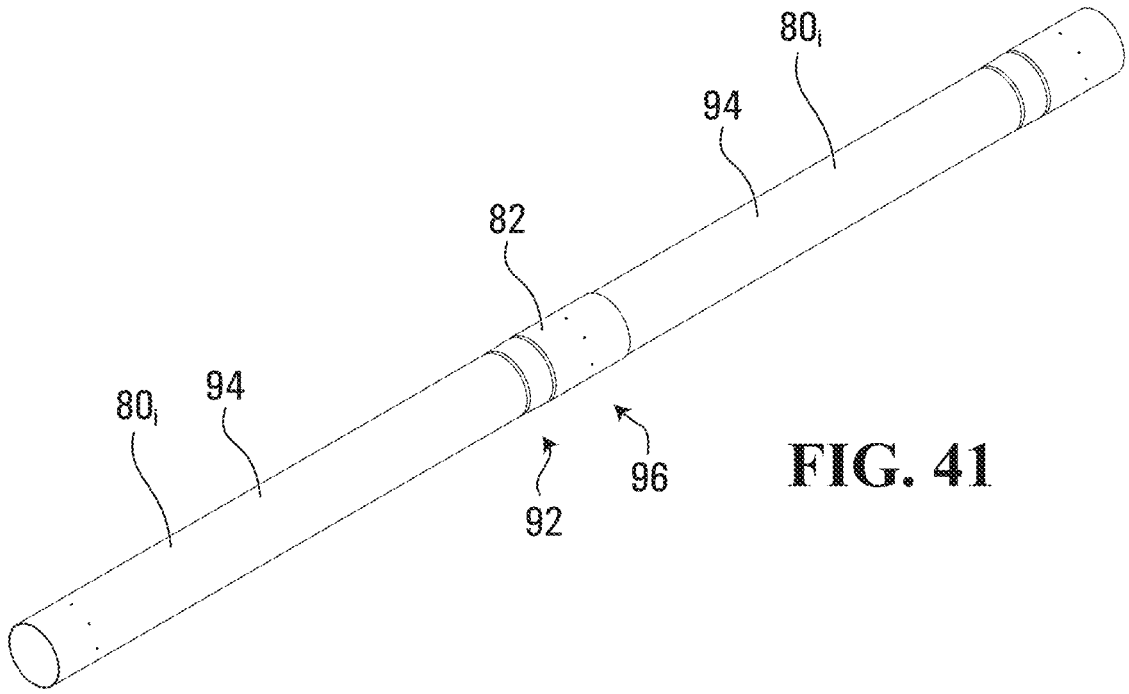
Figure 42:
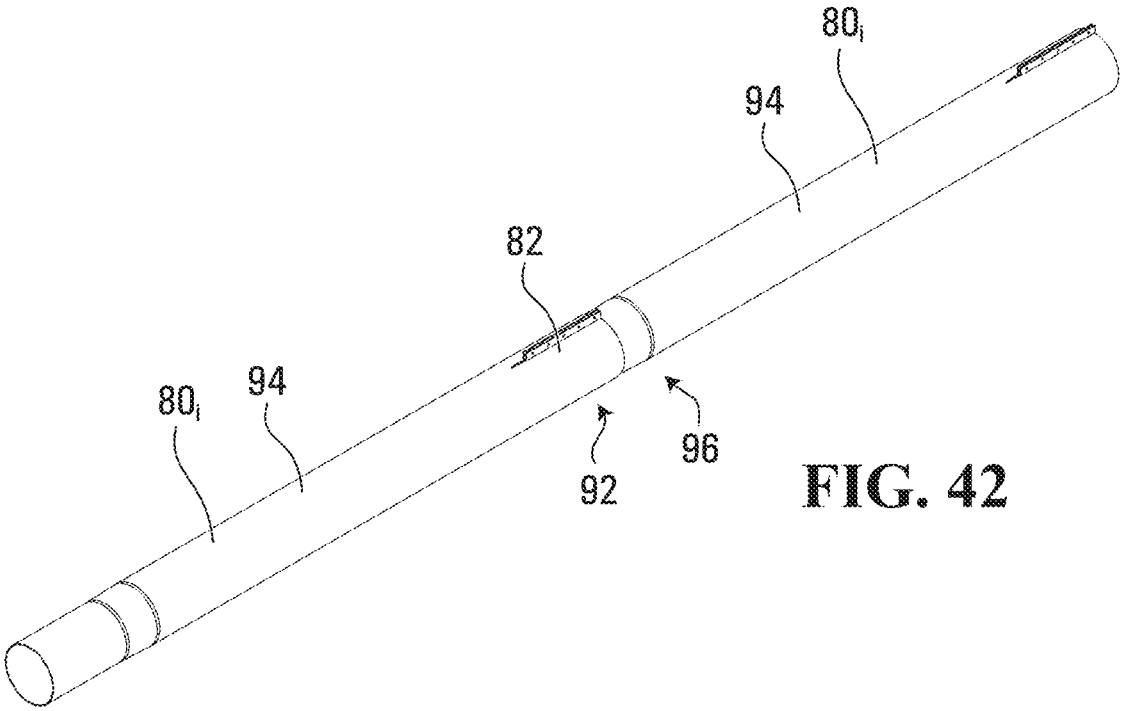

In other embodiments, as shown in Figured 39 to 42, the connector 82 for interconnecting adjacent ones of the beam segments $\mathbf{80}_1$-$\mathbf{80}_M$ may be integral with the beam segments $\mathbf{80}_1$-$\mathbf{80}_M$ (as opposed to be a separate component) and include a dimensional change (e.g., a reduction or expansion) of portions of the beam segments $\mathbf{80}_1$-$\mathbf{80}_M$ to secure the adjacent ones of the beam segments $\mathbf{80}_1$-$\mathbf{80}_M$ to one another. More particularly, in such cases, the connector 82 for interconnecting adjacent ones of the beam segments $\mathbf{80}_1$-$\mathbf{80}_M$ may include an end portion 92 of a beam segment $\mathbf{80}_i$ that has a different (e.g., smaller or larger) cross-section than a longitudinal portion 94 thereof and an end portion 96 of an adjacent beam segment 80 that is configured to receive (or to be received by) the end portion 92 of the beam segment $\mathbf{80}_1$. For instance, in some cases, end portions 92, 96 of the adjacent ones of the beam segments $\mathbf{80}_1$-$\mathbf{80}_M$ may implement a taper connection (e.g. the end portions 92, 96 may implement a conical male portion and a conical female receiving portion), such that, once engaged together, the interconnected end portions 92, 96 may be firmly secured and relative movement between the interconnected end portions 92, 96 may be prevented (i.e. by friction, compression, or a combination thereof), with or without additional fastening means such as mechanical fasteners or adhesives. This type of interconnection may help to improve the mechanical resistance in fatigue of the connector 82 and/or reduce wears at the connector 82 over time and/or facilitate alignment of the end portions 92, 96 during their mutual engagement (as compared with end to end connection without taper, for instance). Additionally or alternatively, such as shown in FIGS. 39, 40 and 42, the end portion 92 may implement a clamping device (e.g. clamp ring, clamp sleeve, or other suitable compression attachment device) for receiving the end portion 96 of the adjacent beam segment 80*j* and compressively removably securing (i.e. clamping) the end portions 92, 96 together once the clamping device is tightened (e.g. by tightening the clamping device, or screws of the clamping device). Alternatively or additionally, as shown in FIG. 41, the end portions 92, 96 implementing the connector 82 may comprise one or more mechanical fasteners (e.g., a bolt, screw, rivet, etc.) to fasten the end portions 92, 96 of adjacent beam segments $\mathbf{80}_1$-$\mathbf{80}_M$.

The beam 32 that is segmented and assembled with the connectors 82 to interconnect the beam segments $\mathbf{80}_1$-$\mathbf{80}_M$ as discussed above may facilitate transport for assembly at the roadway 12 and allows disassembly and repair of damaged ones of the beam segments $\mathbf{80}_1$-$\mathbf{80}_M$ after a car or other vehicle has crashed into the gate 10, efficiently and without impacting a mechanical structure of undamaged ones of the beam segments $\mathbf{80}_1$-$\mathbf{80}_M$.

Figure 43:
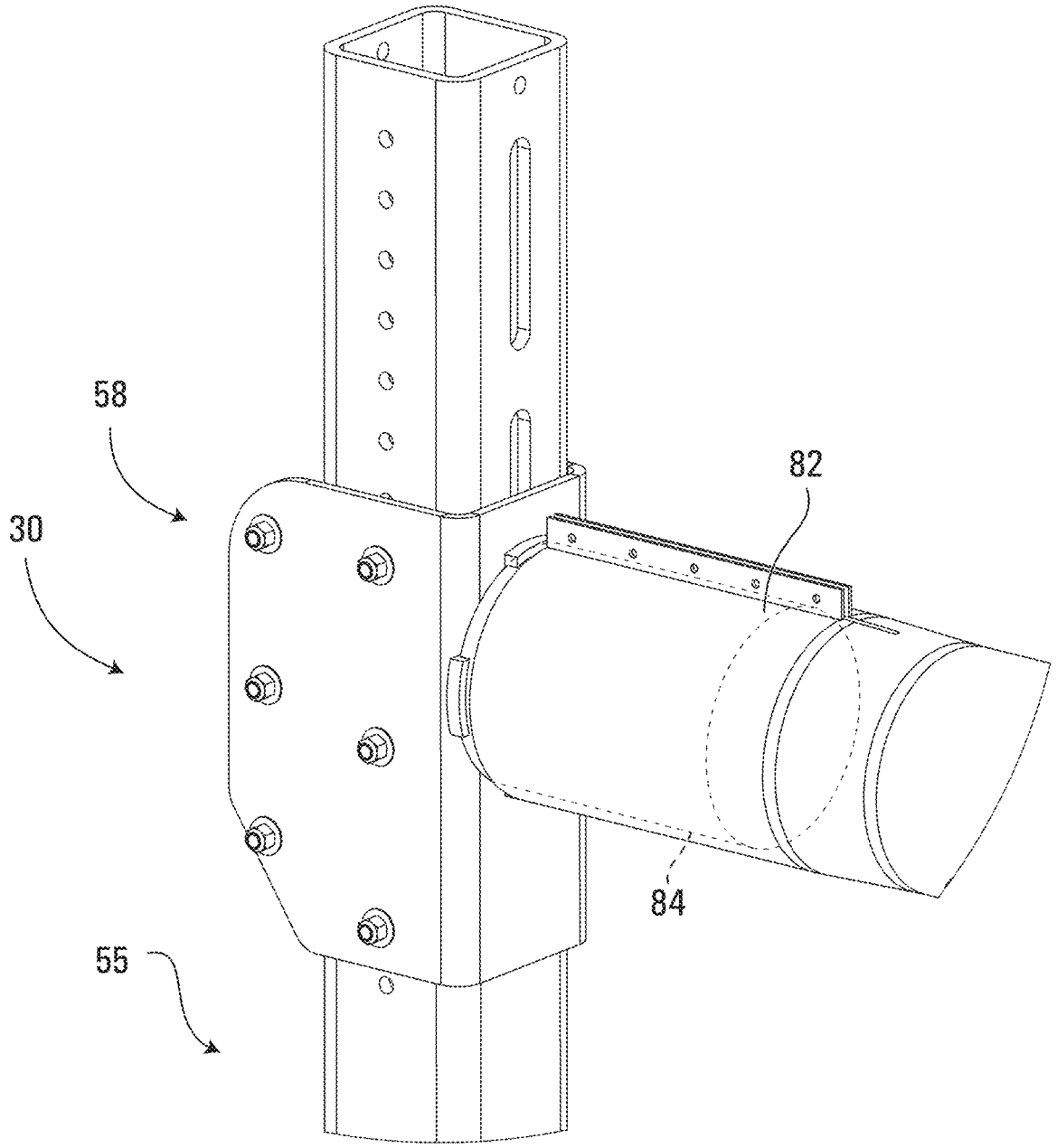
FIGS. 43 to 45 show examples of a connection of the arm to the control system in some embodiments.
Figure 44:
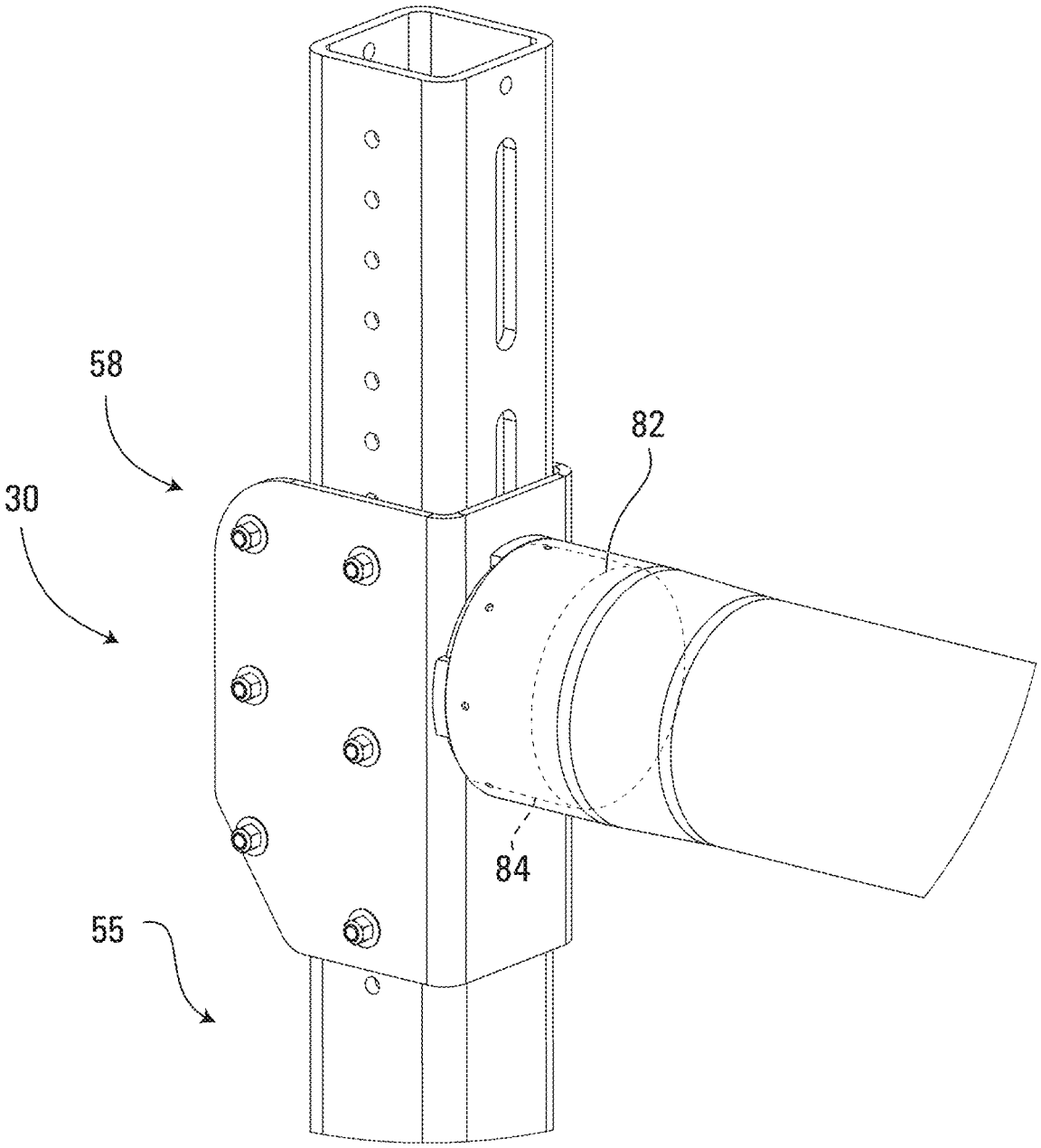
Figure 45:
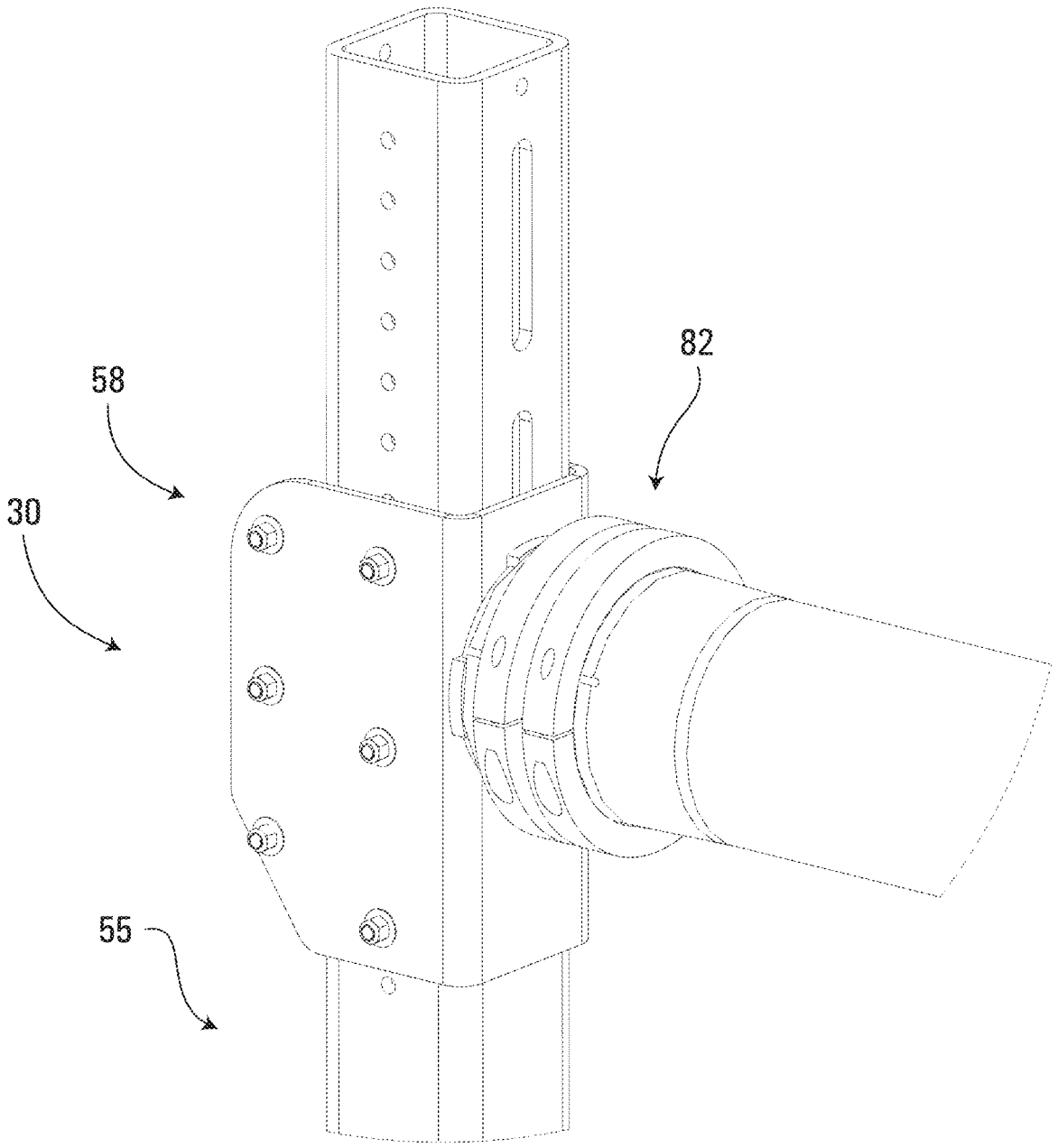

In some embodiments, the beam 32 may be carried by and connected to the support 58 of the control system 30 of the gate 10 similarly as discussed above with respect to the embodiments of the connector 82 for interconnecting adjacent ones of the beam segments $\mathbf{80}_1$-$\mathbf{80}_M$. For instance, as shown in FIGS. 43 to 45, a connector 82, integral with a beam segment $\mathbf{80}_i$ or as a separate part, can be configured to interconnect with the support 58 of the control system 30. The interconnection between the connector 82 and the support 58 can be implemented in many ways. For instance, the support 58 may include a beam-receiving section 84 (e.g., male or female receiving section) for engaging with the connector 82. The connector 82 can then be secured to the beam-receiving section 84 similarly as discussed above with respect to the embodiments of the connector 82 for interconnecting adjacent ones of the beam segments $\mathbf{80}_1$-$\mathbf{80}_M$, including by implementing a taper connection as discussed above.

Figure 50:
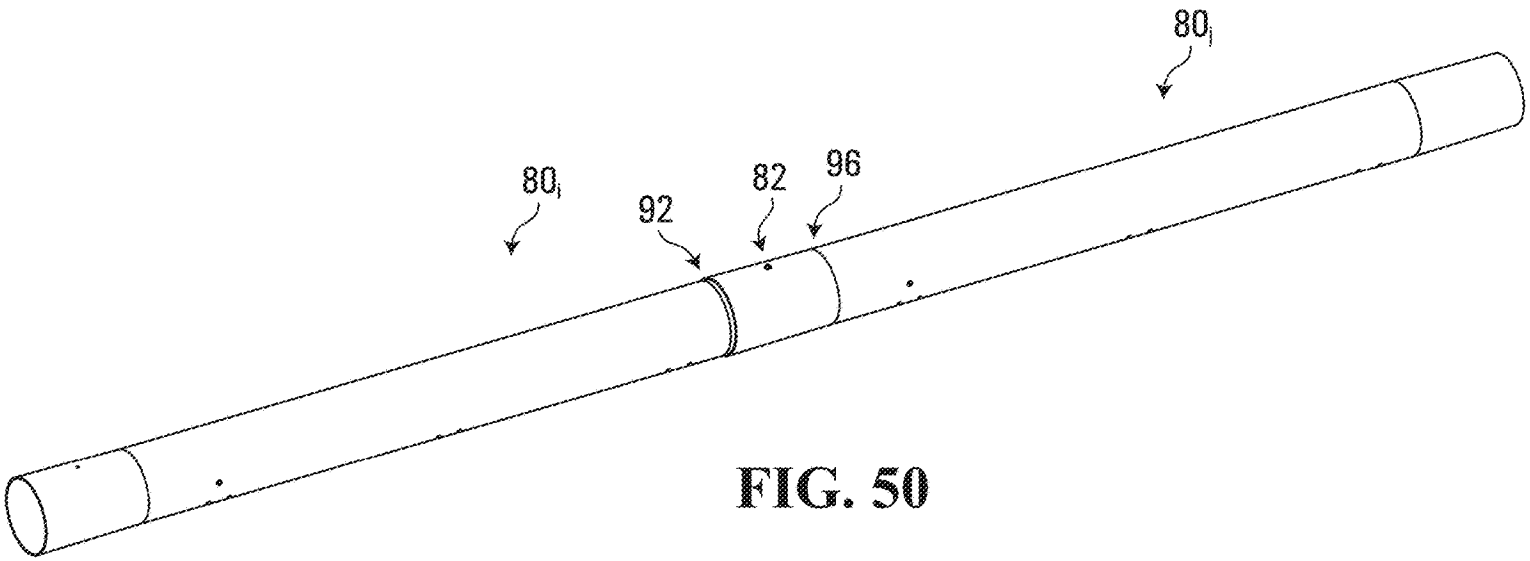
FIGS. 50 to 52 show additional examples of connectors interconnecting adjacent beam segments of the beam in other embodiments.
Figure 51:
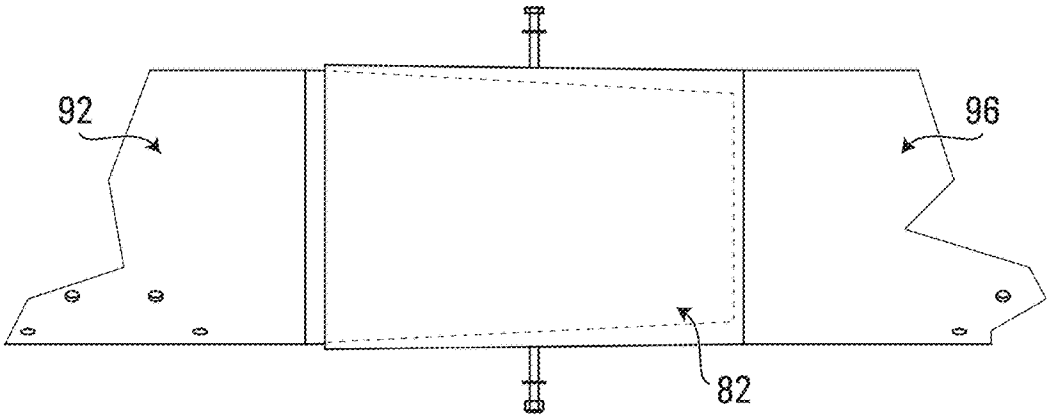
Figure 52:
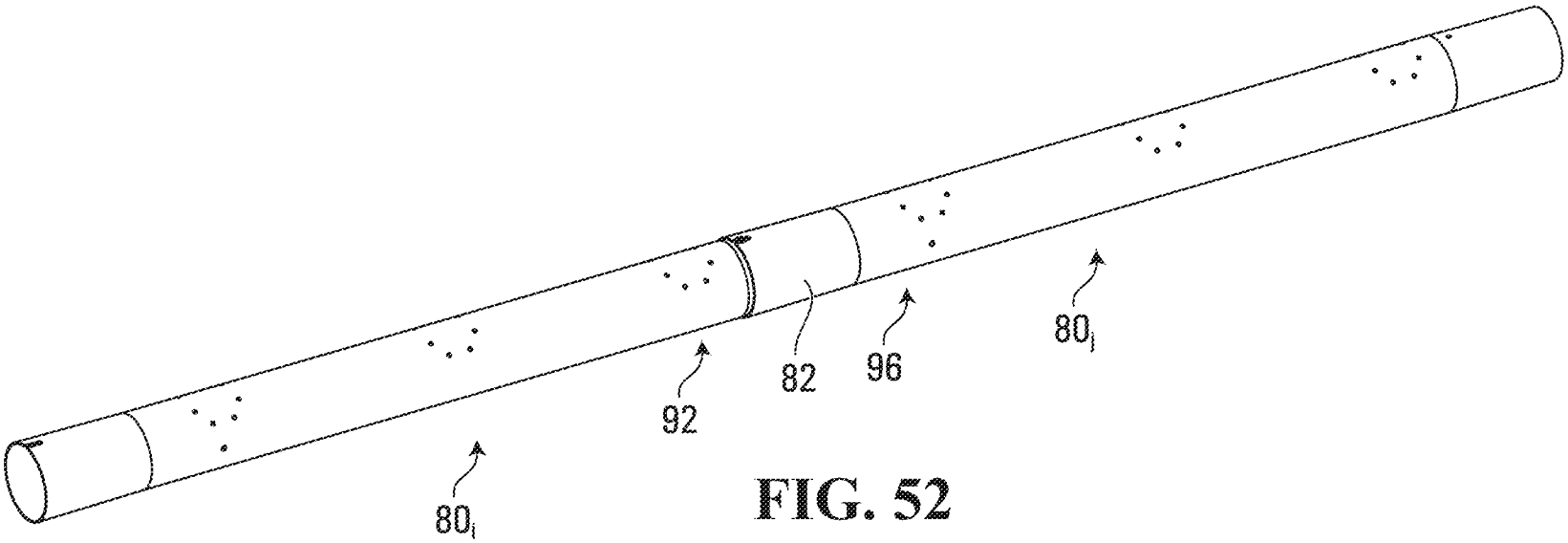
Figure 53:
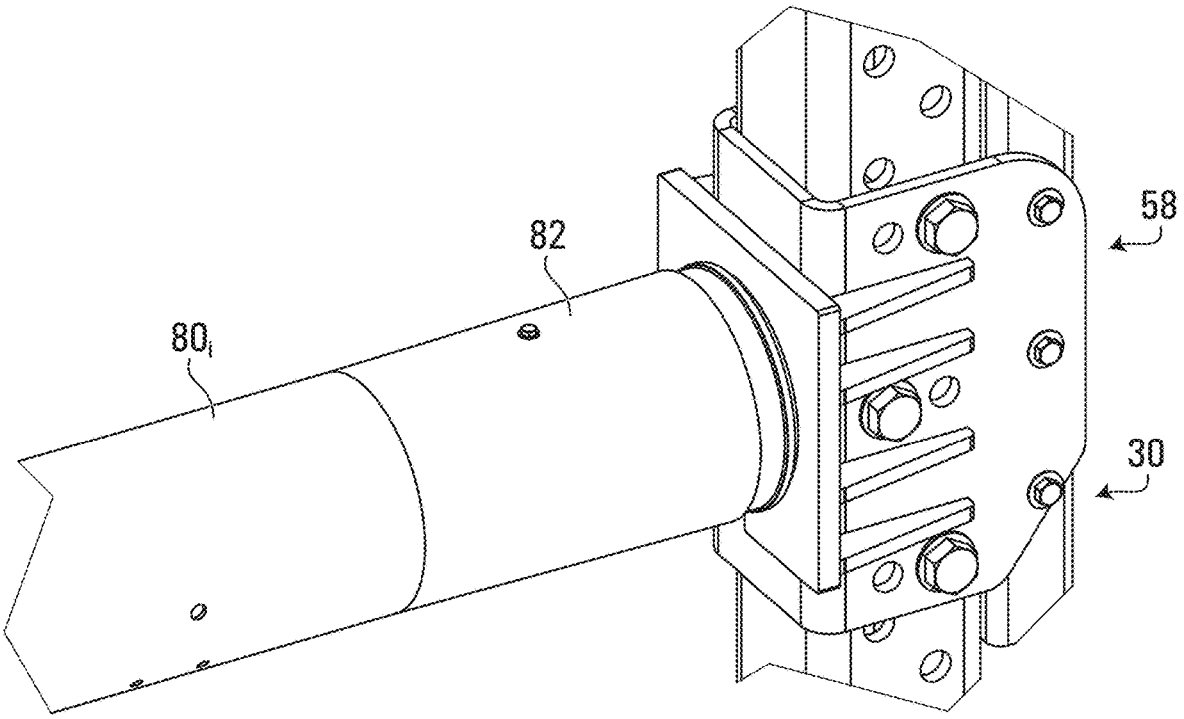
FIGS. 53 to 55 show additional examples of a connection between the beam and the control system in other embodiments.
Figure 54:
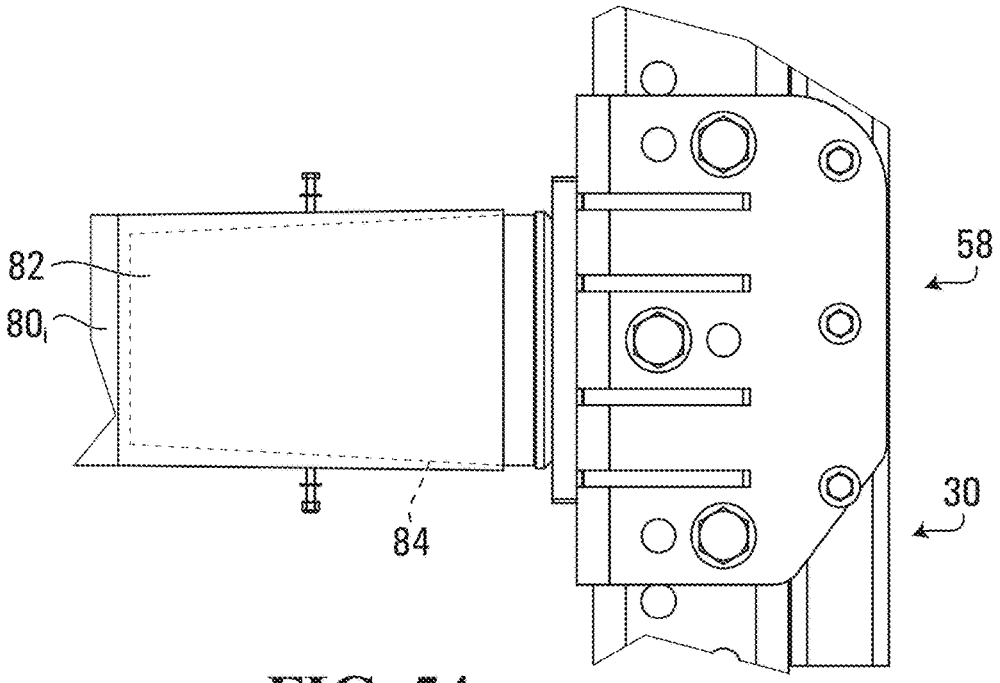
Figure 55:
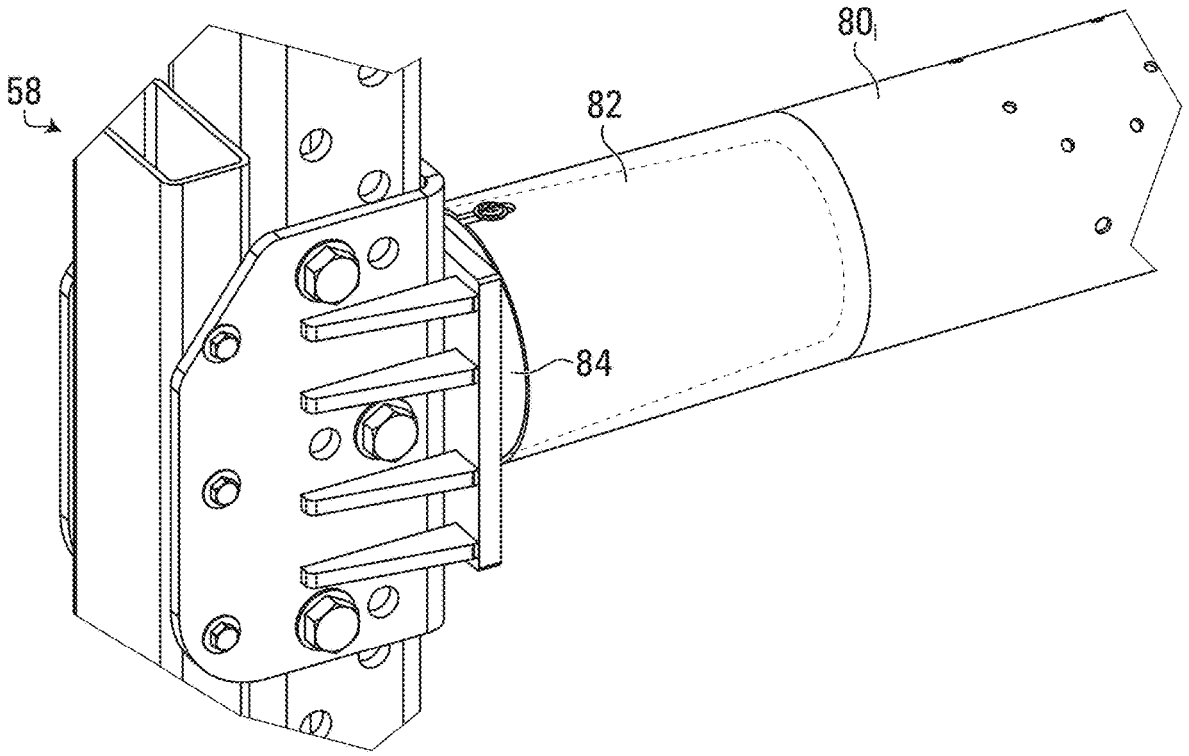

FIGS. 50 to 55 show other embodiments of connectors 82 interconnecting adjacent ones of the beam segments $\mathbf{80}_1$-$\mathbf{80}_M$ and/or the support 58. More particularly, as shown in FIGS. 50 and 51, in some embodiments, the connector 82 may be integral with the end portion 96 of the beam segment $\mathbf{80}_j$ and is configured to receive the end portion 92 of the adjacent beam segment $\mathbf{80}_i$. In this case, the connector 82 implements a taper connection (e.g. conical male portion and a conical female receiving portion) that firmly secures adjacent ones of the beam segments $\mathbf{80}_1$-$\mathbf{80}_M$, and prevents relative movement between the interconnected end portions 92, 96 (i.e. by friction, compression, or a combination thereof), as discussed above in more details. Also, in this case, the connector 82 further includes a mechanical fastener extending therethrough to further secure the connection between end portions 92, 96 of the adjacent ones of the beam segments $\mathbf{80}_1$-$\mathbf{80}_M$. FIG. 52 shows another example of the connector 82. In this case, the connector 82, which is integral with the end portion 96 of the beam segment $\mathbf{80}_j$, also implements a taper connection, as discussed above with respect to previously discussed embodiments, and further includes a void (e.g. a slot) configured to slidably engage with a mechanical fastener (e.g., a bolt) fastenable to the end portion 92 (e.g., to a rivet nut fixed to the end portion 92). Once tightened, the mechanical fastener inserted into the void and fastened to the end portion 92 further secures the connection between the end portions 92, 96 of the adjacent ones of the beam segments $\mathbf{80}_1$-$\mathbf{80}_M$. FIGS. 53 and 54 show another example of interconnection between the connector 82 and the support 58 using a similar configuration of connector 82 as discussed above and with reference to FIGS. 50 and 51. In this case, the support 58 has a beam-receiving section 84 (as discussed above with respect to another embodiment) that interconnects with the connector 82 and implement a taper connection therebetween, and a mechanical fastener extending through the connector 82 and the beam-receiving section 84 further secures the connection therebetween. FIG. 55 shows another example of interconnection between the connector 82 and the support 58 using a similar configuration of connector 82 as discussed above and with reference to FIG. 52. In this case, the connector 82 also implements a taper connection, as discussed above with respect to previously discussed embodiments, and further includes a void (e.g. slot) configured to slidably engage with a mechanical fastener (e.g. a bolt) fastenable to the beam-receiving section 84 (e.g. to a rivet nut fixed to the beam receiving section 84). Once tightened, the mechanical fastener inserted into the void and fastened to the beam-receiving section 84 further secures the connection between the connector 82 and the support 58.

If an oncoming vehicle (e.g., a passenger car or pickup truck) crashes into the gate 10, while it may be desired that the visible arrangement 38 would deflect without breaking, at least part of the visible arrangement 38 which may be broken by the oncoming vehicle may be replaceable. For example, in some embodiments, in such situations, the arm 20 may be cleared of any damaged (e.g., broken, torn, shredded, etc.) part of the visible arrangement 38, such as one or more of the visible members $\mathbf{33}_1$, $\mathbf{33}_2$, $\mathbf{34}_1$-$\mathbf{34}_{12}$, which can be replaced by replacement visible members that may be fastened, bonded or otherwise affixed to the beam 32 and/or one another with one or more mechanical fasteners, an adhesive and/or other affixing techniques.

In some embodiments, the arm 20 may be configured such that, if crashed into by a heavy truck, a bus or other large vehicle significantly larger than a pickup truck, the arm can detach from the control system 30 at impact. For example, in some embodiments, the gate 10 may comprise a release mechanism such that, when the gate 10 is hit, in response to a sufficient force at the control system 30, such as at the support 58 implementing the pivot 55, a connection of the arm 20 to the support 58 is released (e.g., disengages or breaks). This may allow the heavy truck, bus or other large vehicle to continue its course with the arm 20 in one piece in front of it, and may thus avoid sections of the arm 20 becoming projectiles that could potentially penetrate into the vehicle's occupant compartment or present undue hazard to other traffic.

The gate 10, including the arm 20 and the control system 30, may be implemented in various other ways in other embodiments.

Figure 12:
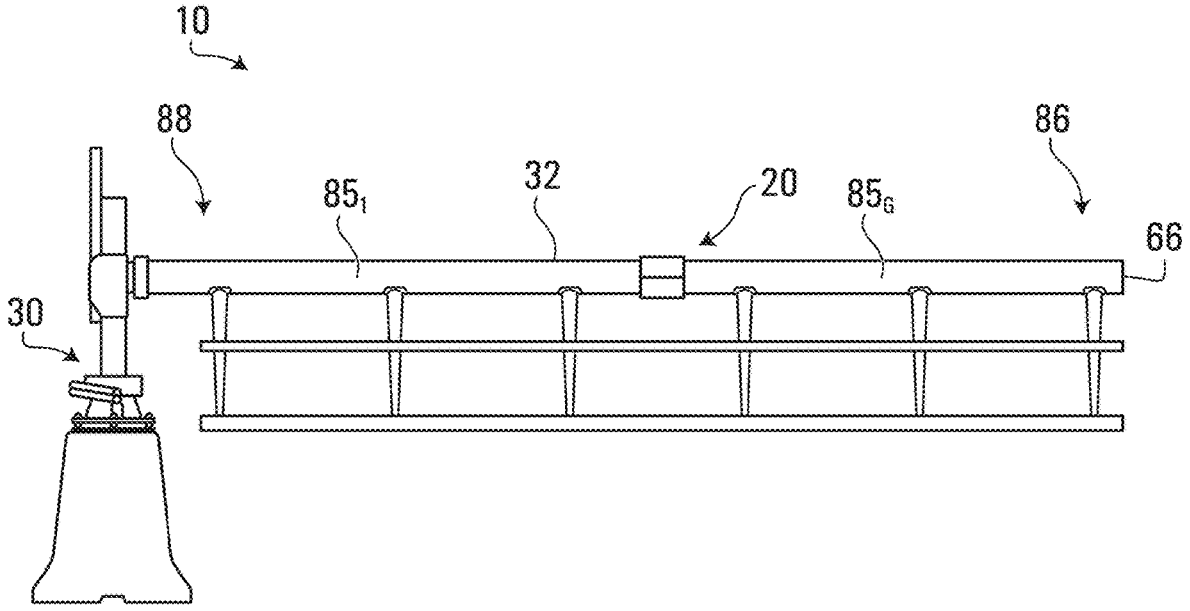
FIGS. 12 and 13 show examples of embodiments in which a linear weight of the beam varies.
Figure 13:
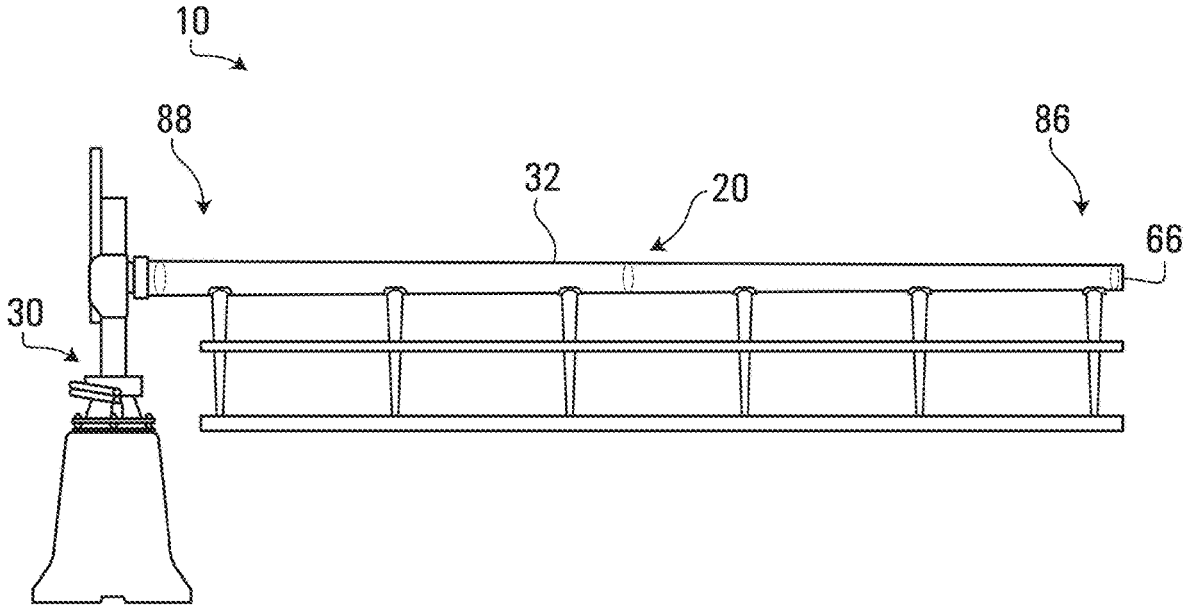

For example, in some embodiments, as shown in FIGS. 12 and 13, the arm 20 may have a linear weight, i.e., a weight per unit length, that varies in the longitudinal direction of the arm 20 such that a distal part 86 of the arm 20 may be lighter than a proximal part 88 of the arm 20 to reduce a moment at the control system 30. For instance, in some embodiments, as shown in FIG. 12, the beam 32 may comprise a plurality of materials $\mathbf{85}_1$-$\mathbf{85}_G$ that are different from one another along respective portions of the arm 20. For instance, in some embodiments, the material $\mathbf{85}_G$ of the beam 32 in the distal part 86 of the arm 20 may be less dense than the material $\mathbf{85}_1$ of the beam 32 in the proximal part 88 of the arm 20. Alternatively or additionally, as shown in FIG. 13, a cross-section of the beam 32 may vary along respective portions of the arm 20. For instance, in some embodiments, the cross-section of the beam 32 in the distal part 86 of the arm 20 may be smaller than the cross-section of the beam 32 in the proximal part 32 of the arm 20.

Figure 14:
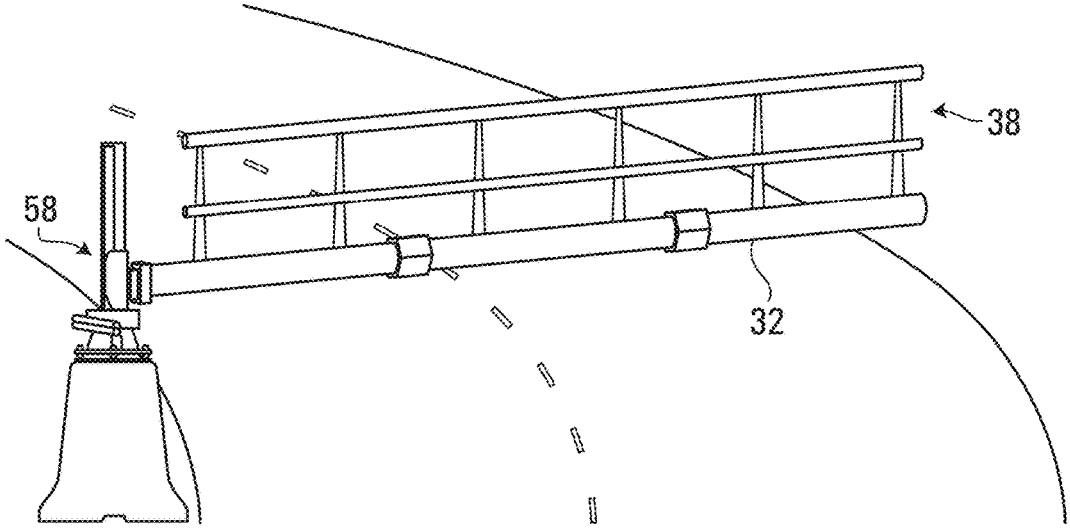
FIG. 14 shows an example of another embodiment of the beam.
Figure 15:
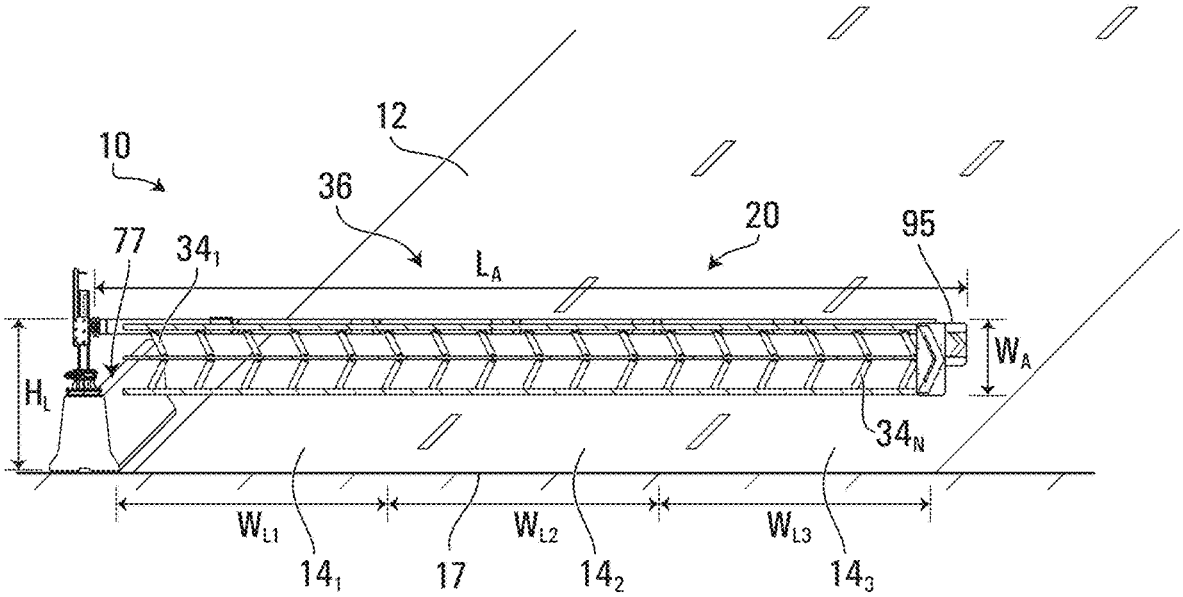
FIGS. 15 to 20 show another example of another embodiment of the arm.
Figure 16:
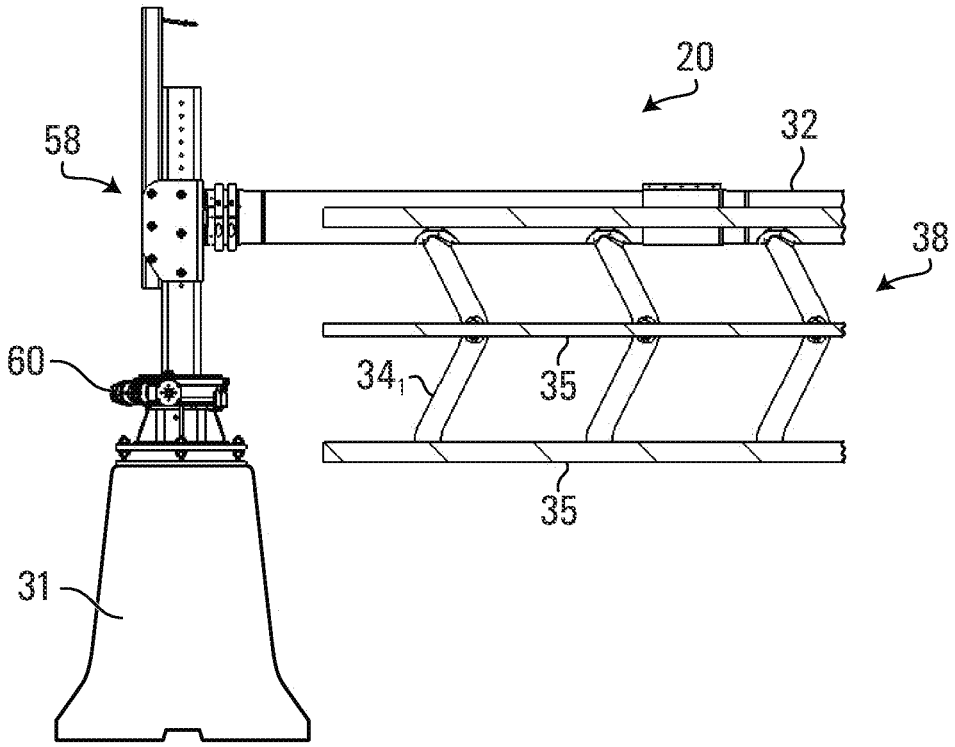
Figure 17:
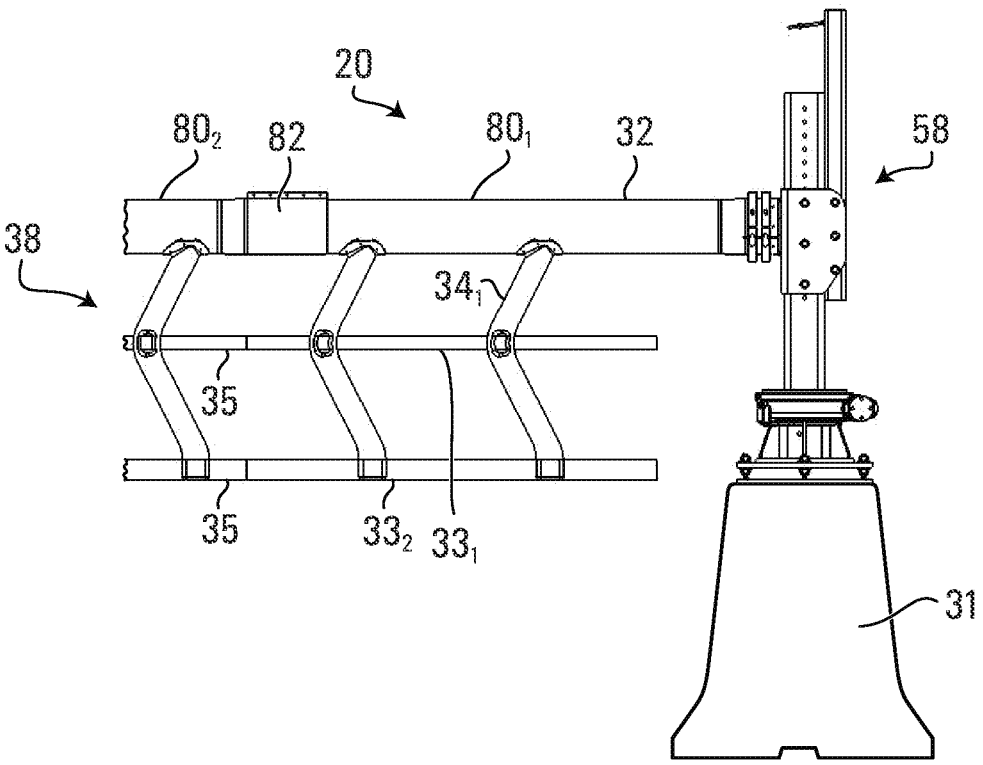
Figure 18:
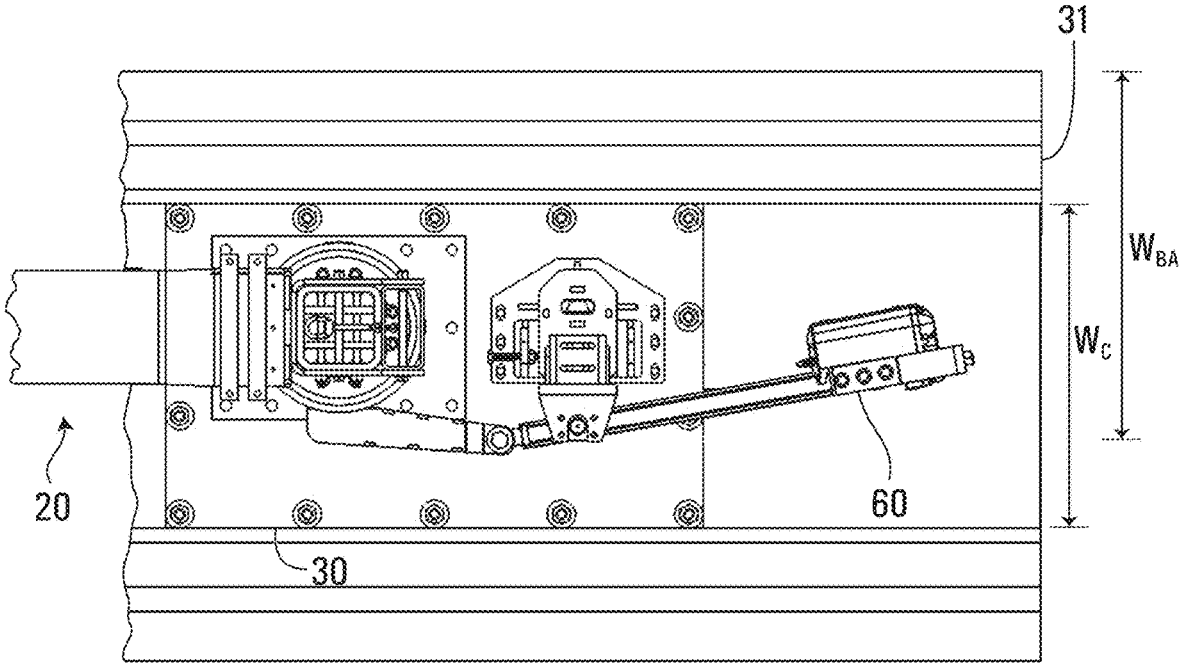
Figure 19:
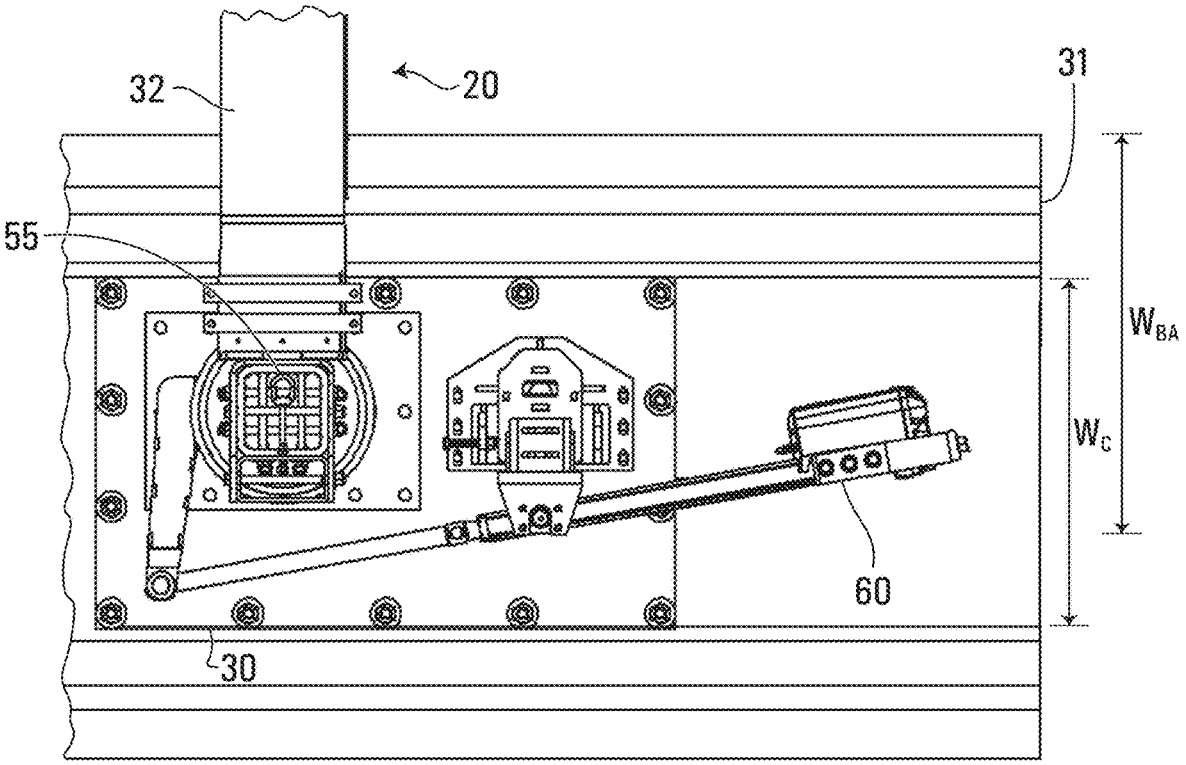

As another example, in some embodiments, as shown in FIG. 14, the beam 32 may be located lower and the visible arrangement 38 may project upwardly from beam 32. For instance, in some embodiments, this may be achieved by inversing what is described above in respect of the beam 32 and the visible arrangement 38. In some embodiments, the beam 32 may be located such that it would not be cleared by an oncoming vehicle such as a passenger car or a pickup truck. In such cases, the beam 32 may be positioned lower than a windshield for these vehicles, such as at a bumper level, to reduce impact to their windshield.

Figure 46:
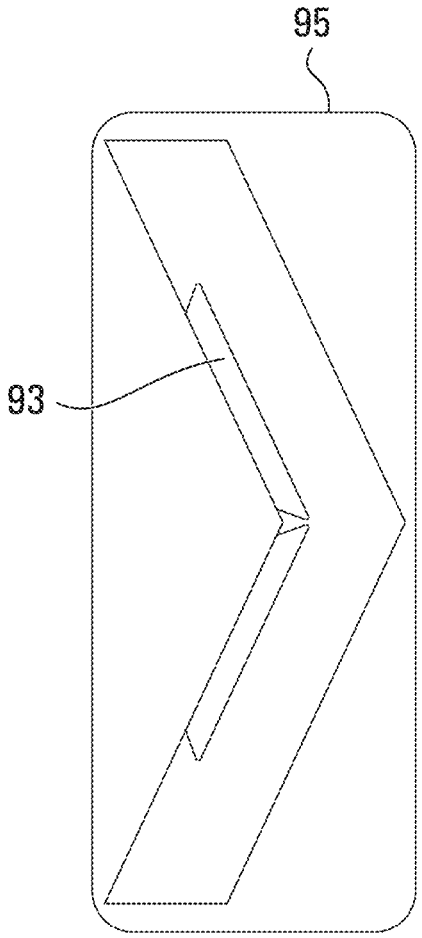
FIGS. 46 and 47 show examples of a sign of the arm.
Figure 47:
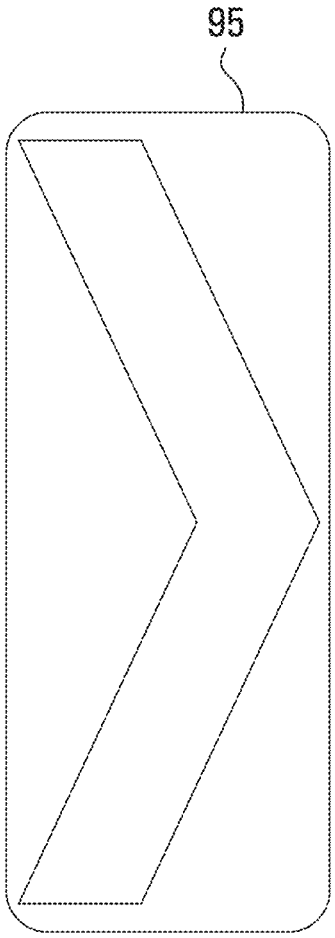
Figure 48:
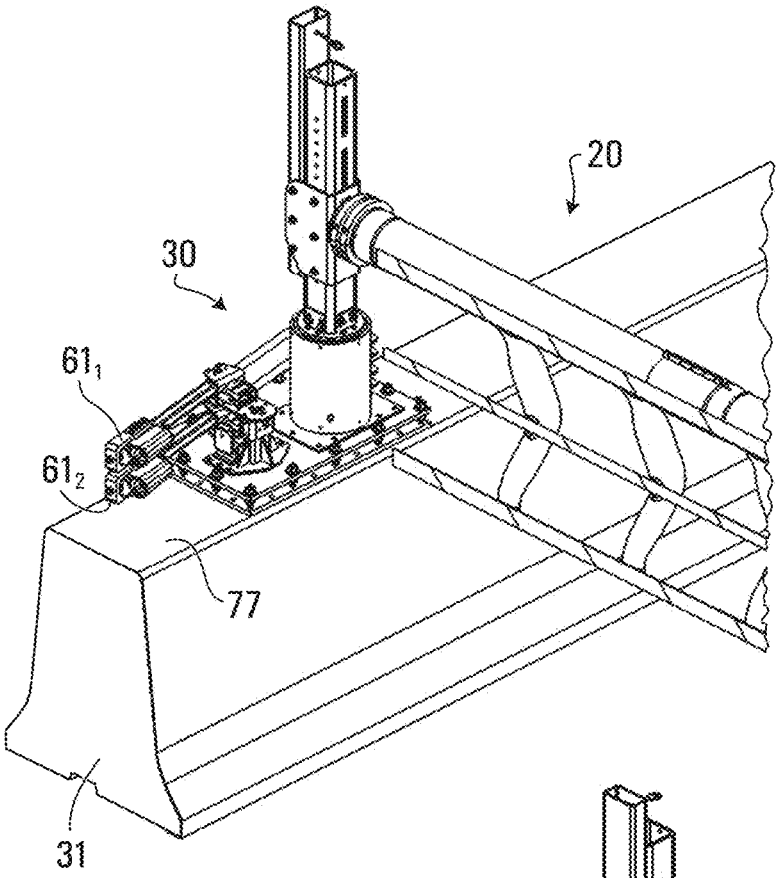
FIGS. 48 and 49 show part of the control system of the gate.
Figure 49:
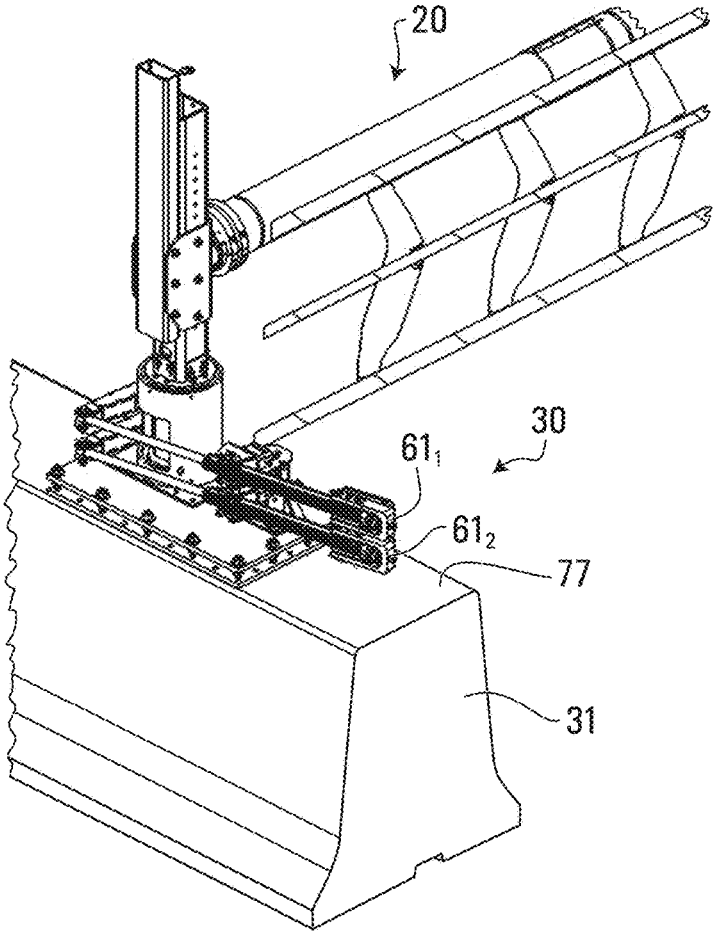

As another example, in some embodiments, the visible arrangement 38 may be constructed in any other suitable manner. For instance, in some embodiments, as shown in FIGS. 15 to 20, transversal visible members $\mathbf{34}_1$-$\mathbf{34}_N$ may extend obliquely to the longitudinal direction of the beam 32. In this example, the transversal visible members $\mathbf{34}_1$-$\mathbf{34}_N$ are disposed in an arrow-like manner to point in a direction (i.e., here towards the right) indicative of where the oncoming traffic should go in view of closure effected by the gate 10. Also, in some embodiments, the arm 20 may comprise a sign 95 informing of (e.g., pointing in) the direction indicative of where the oncoming traffic should go in view of closure effected by the gate 10. For instance, in this embodiment, as shown in FIGS. 46 and 47, the sign 95 may be a chevron sign. In some examples, the sign 95 may be illuminatable, i.e., comprise a light source 93 to illuminate the sign 95. The light source 93 may comprise light-emitting diodes (LEDs) or any other suitable light-emitting element.

As another example, in some embodiments, the control system 30 may be implemented in any other suitable way. For instance, in some embodiments, as shown in FIGS. 21 to 28, the actuator 60 may comprise a rotary actuator 161. For example, in this embodiment, the rotary actuator 161 comprises a slewing drive 91 that includes a worm gearbox. This may provide high torque and high strength in a small size. In this case, the control system 30 may be without any linear actuator. This may help for compactness of the control system 30.

Figure 29:
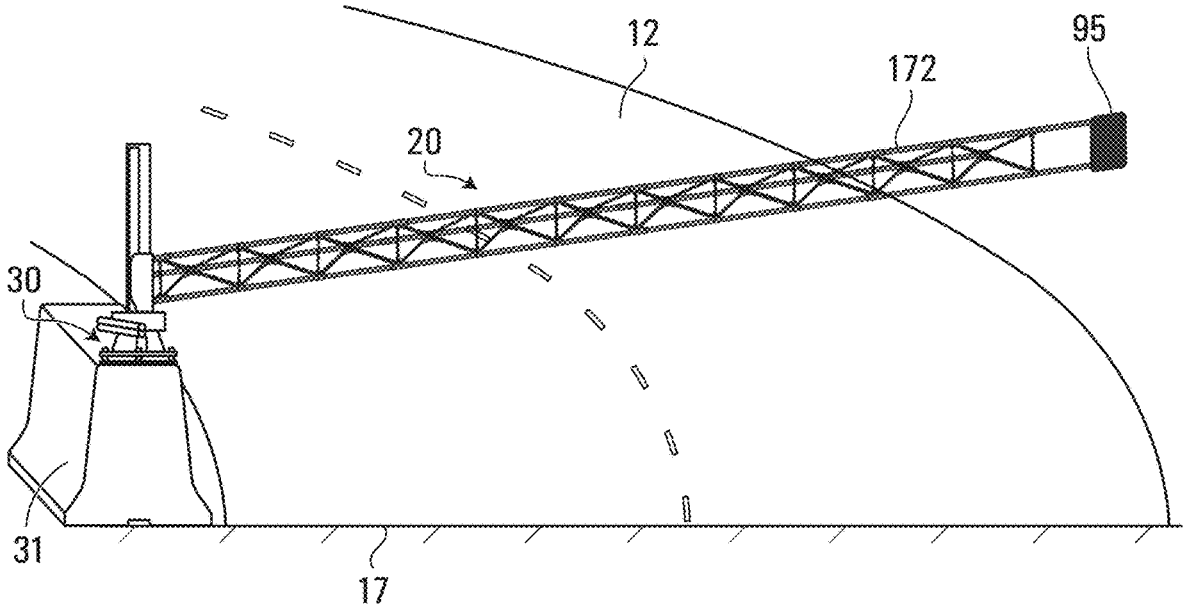
FIG. 29 shows an example of a variant in which the arm comprises an aluminum truss.
Figure 30:
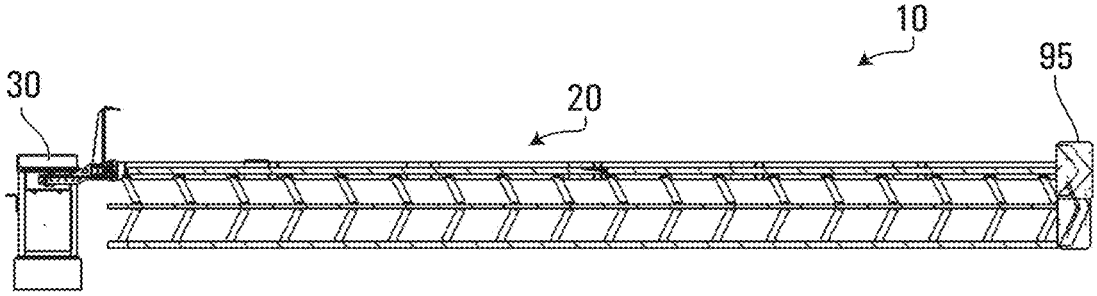
FIGS. 30 to 38 show an example of a variant in which the arm is movable vertically relative to the control system.
Figure 31:
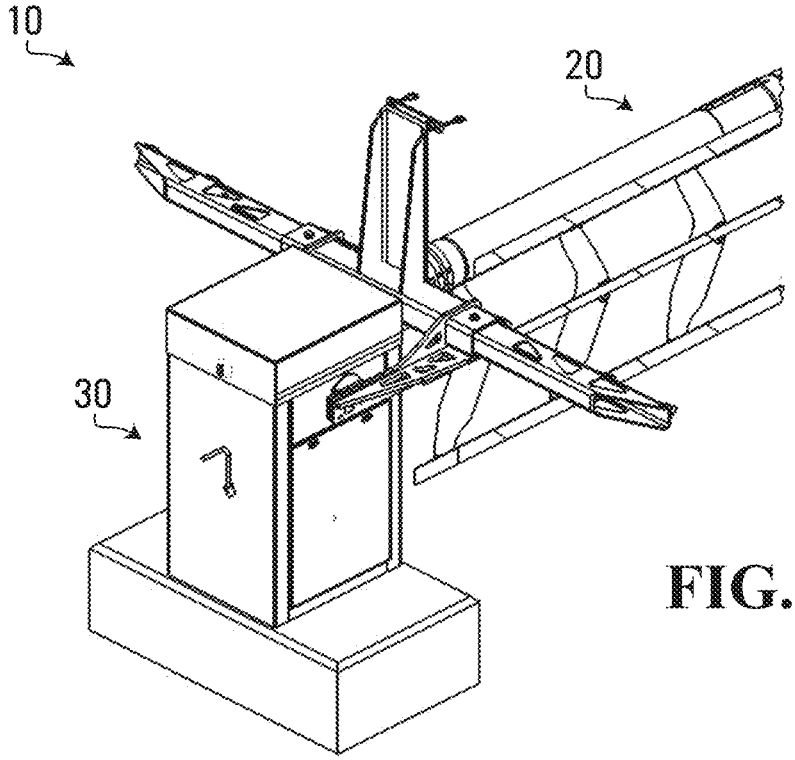
Figure 32:
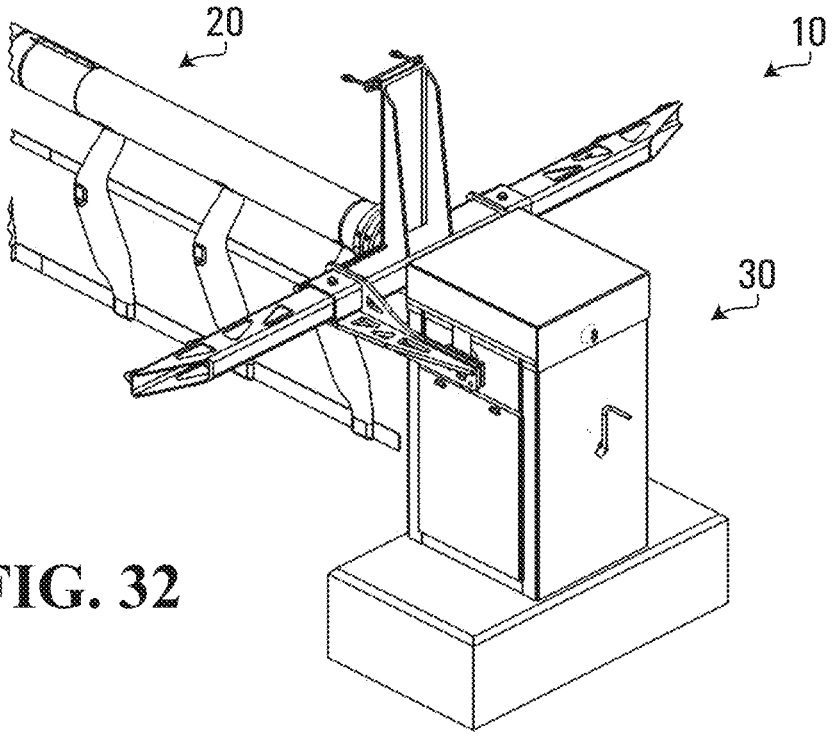
Figure 33:
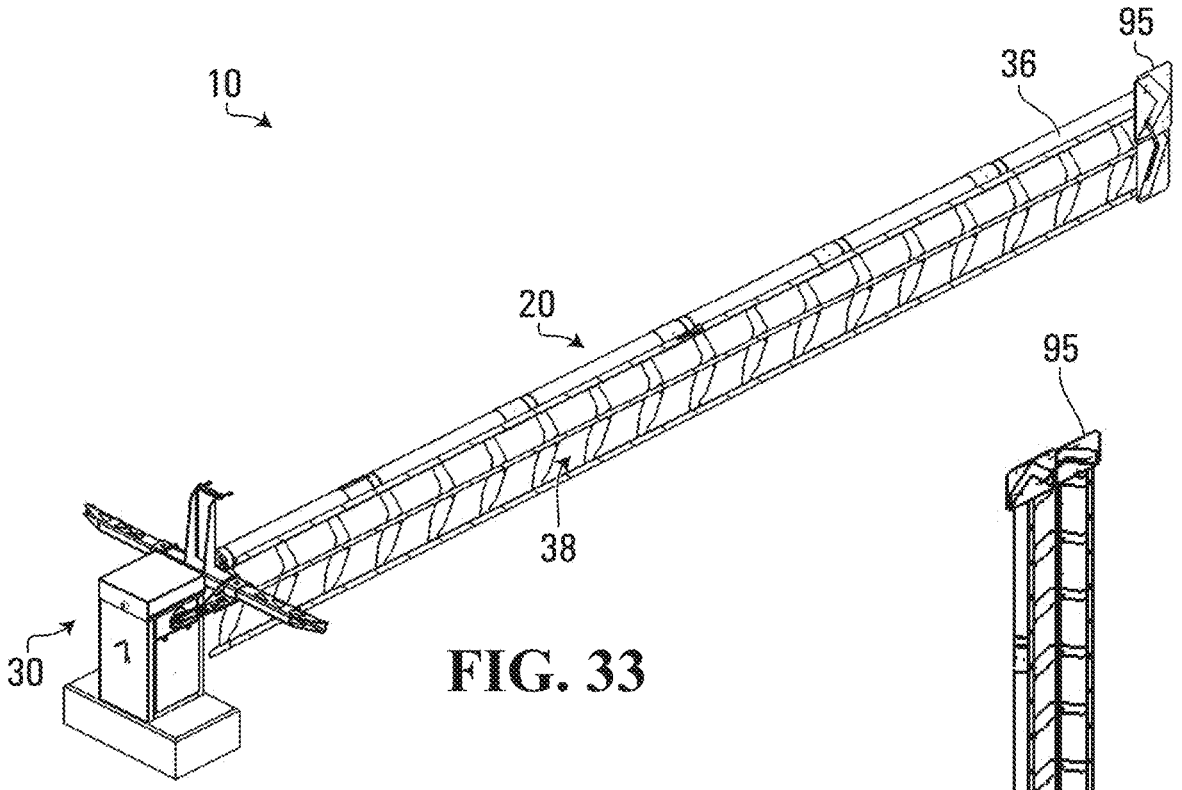
Figure 34:
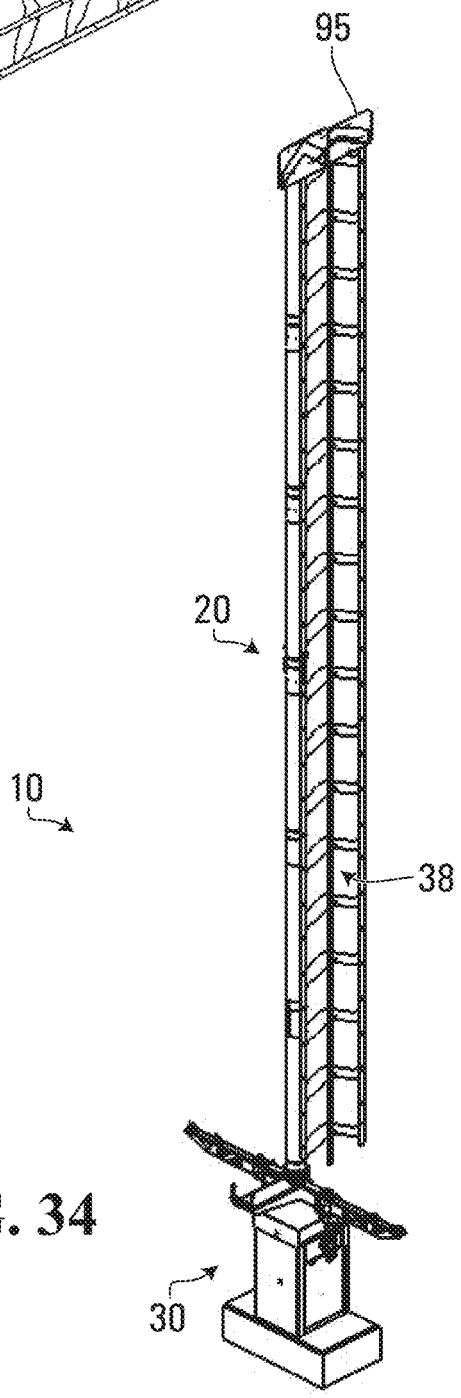
Figure 35:
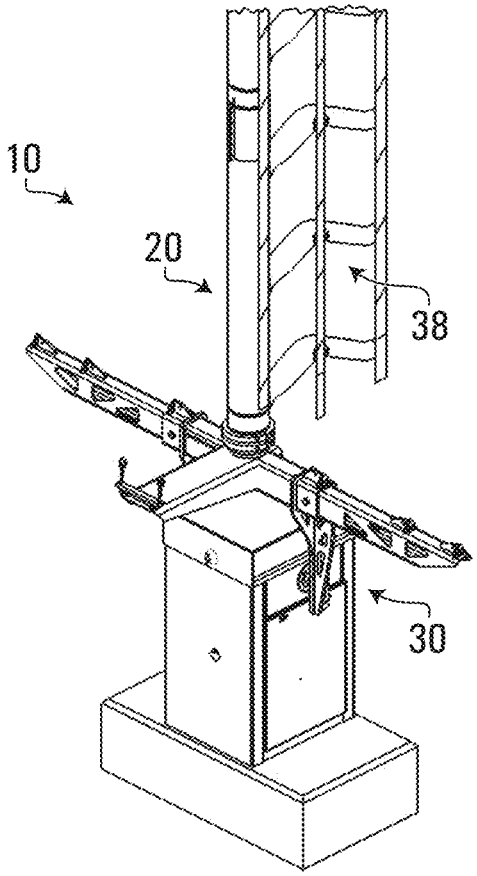
Figure 36:
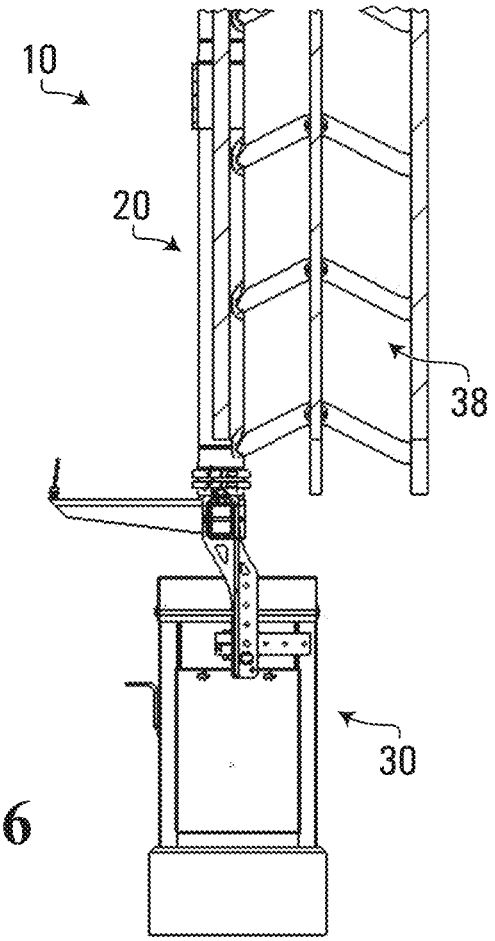
Figure 37:
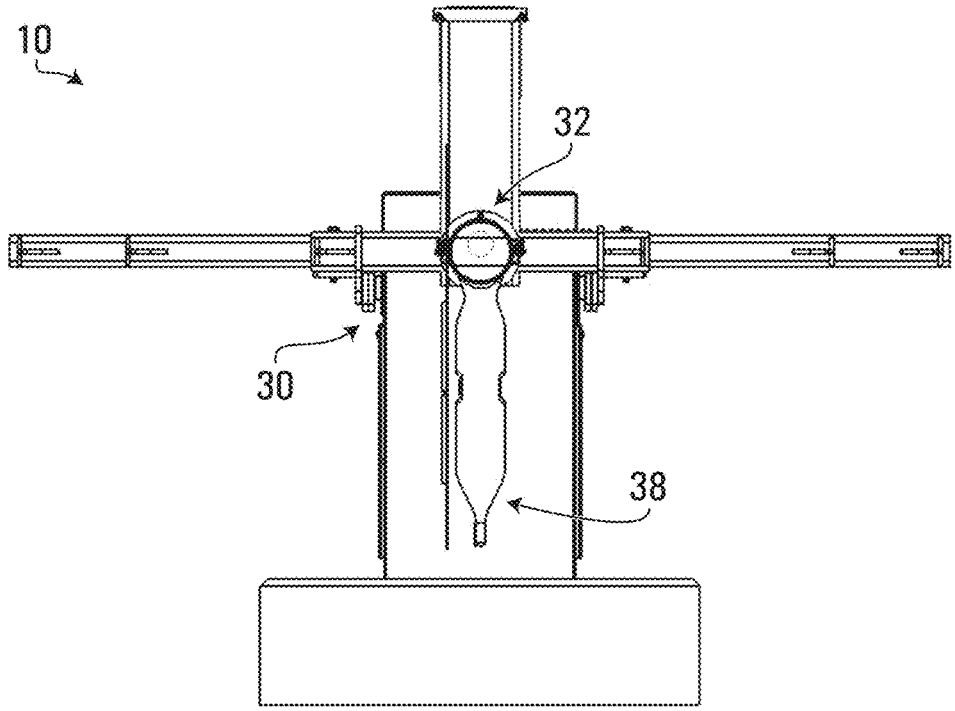
Figure 38:
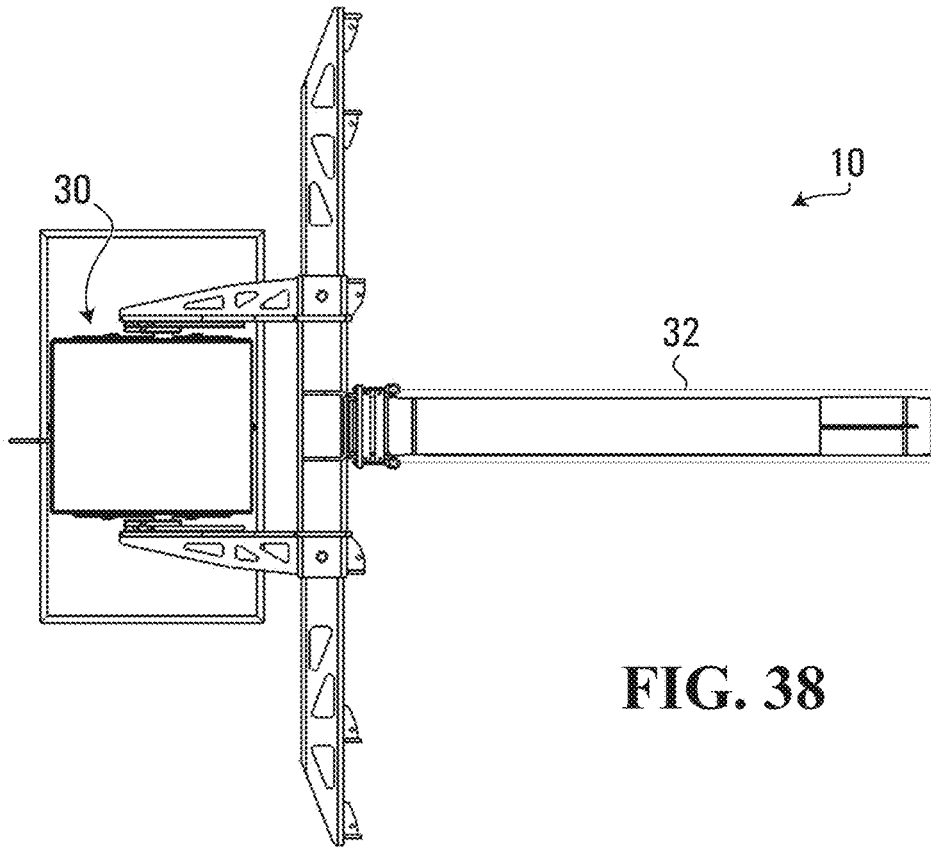

As another example, in some embodiments, as shown in FIG. 29, the arm 20 may comprise an aluminum truss 172. In some situations, the aluminum truss 172 may provide the structural integrity of the arm 20 instead of using a beam such as the beam 32 discussed above to increase a stiffness and a strength of the arm 20, thereby potentially reducing a deflection of the arm 20. The aluminum truss 172 may thus be used in some situations to alleviate the deflection of the arm 20 that is cantilevered and allow the arm 20 to span over longer distances (e.g. large roadways, bridges/tunnels, country roads) without jeopardizing the utility and operability of the gate 10. This may however affect a capacity of the gate 10 to be crash-tested.

Figure 20:
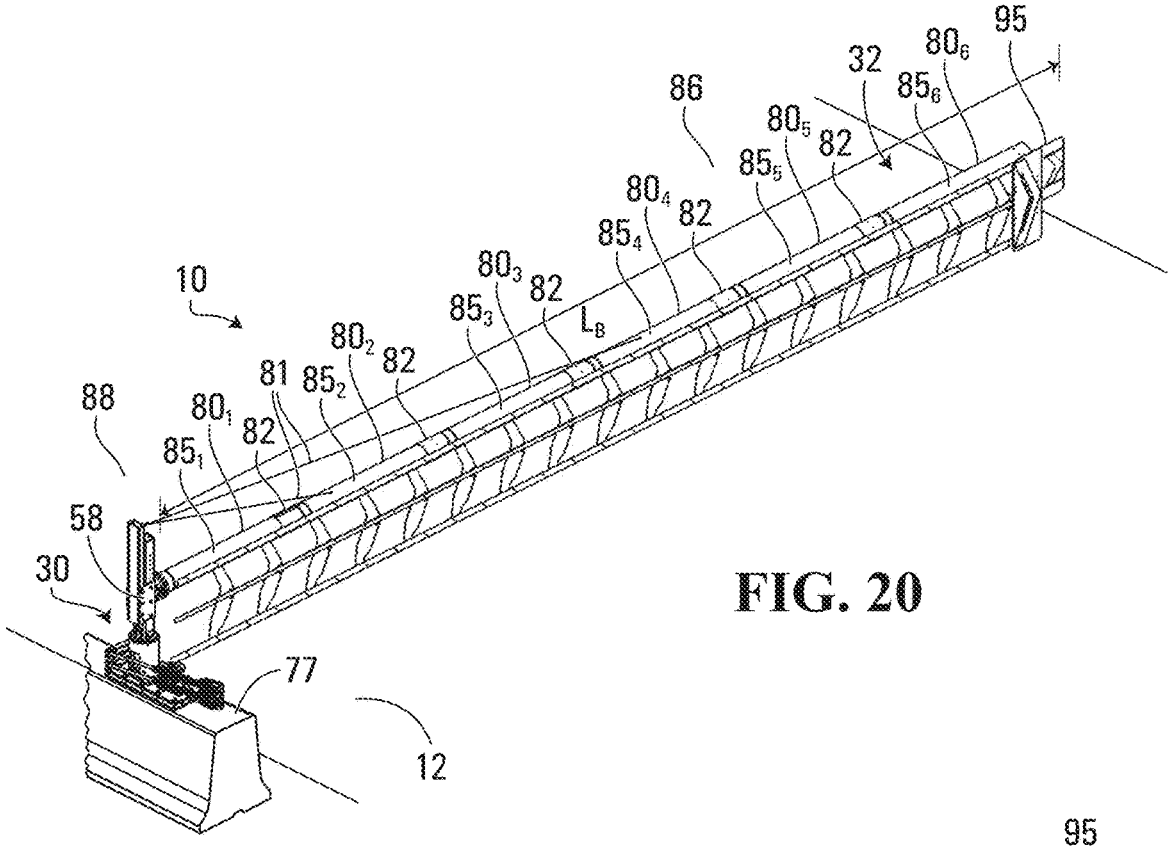
Figure 21:
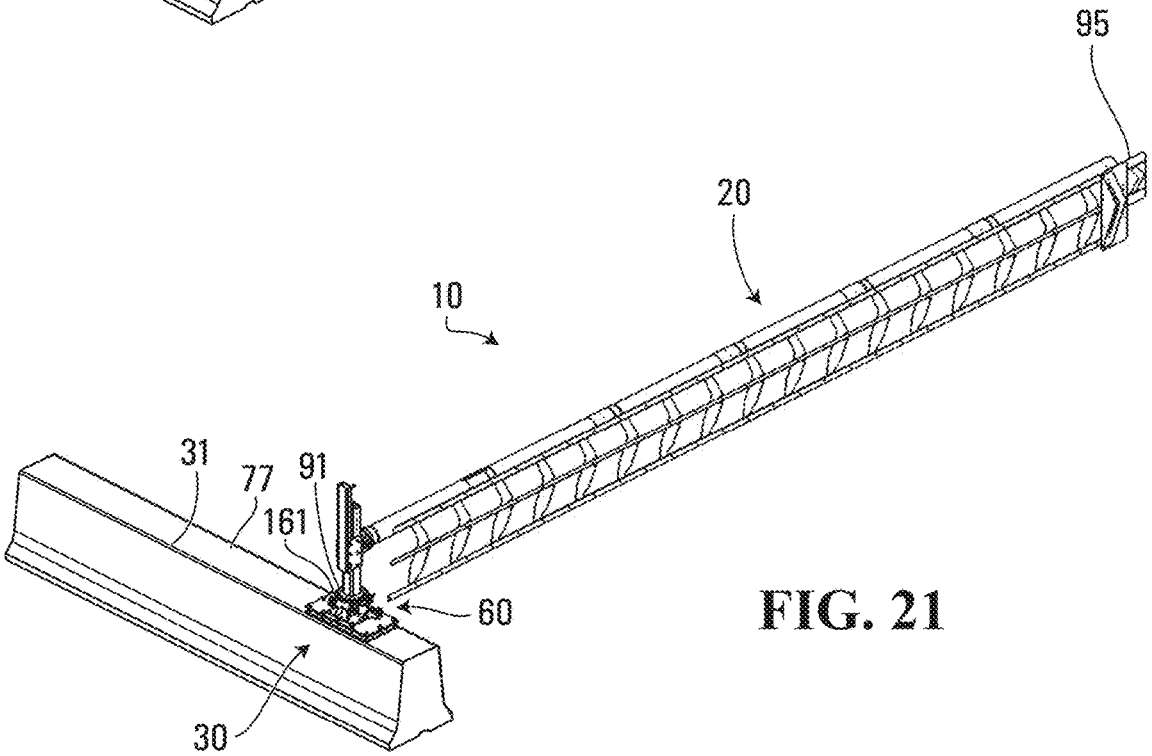
FIGS. 21 to 27 show an example of another embodiment of the control system.
Figure 22:
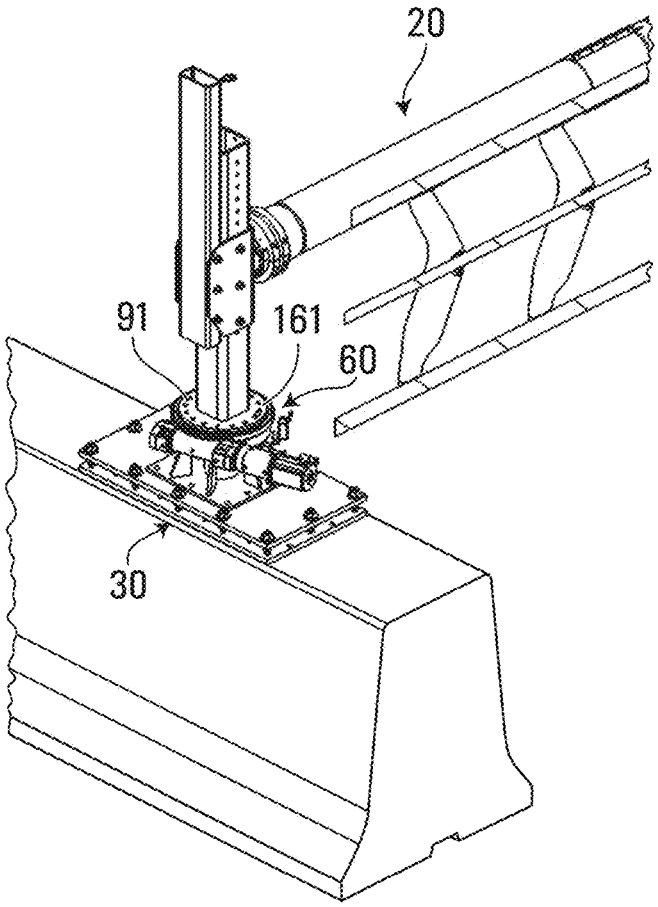
Figure 23:
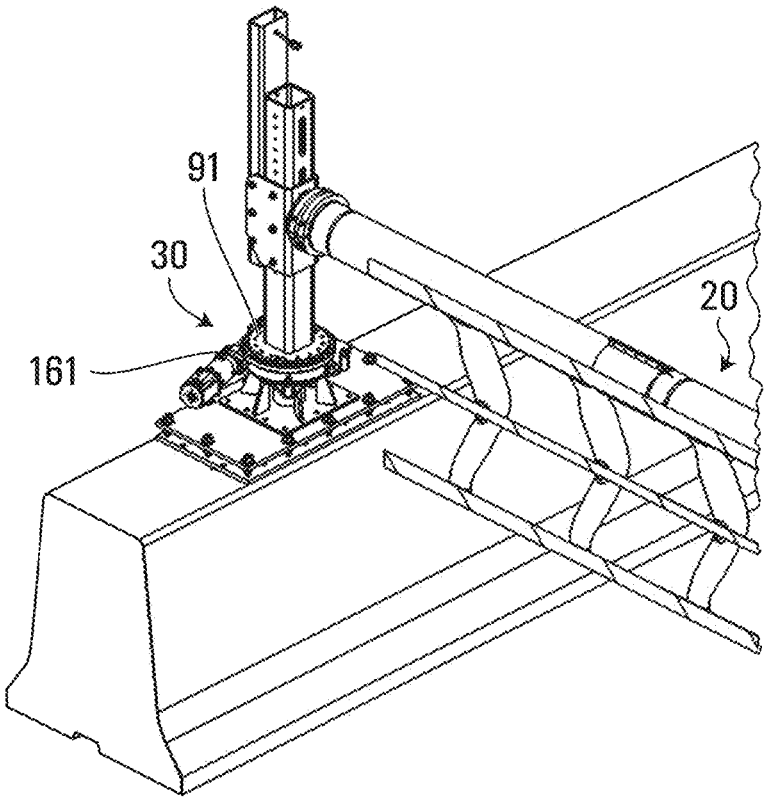
Figure 24:
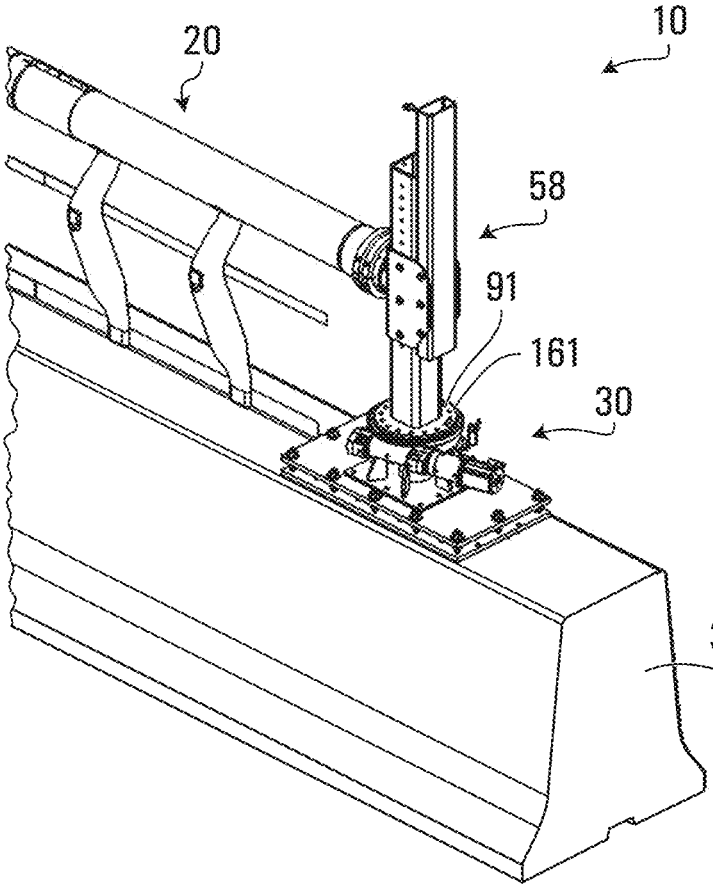
Figure 25:
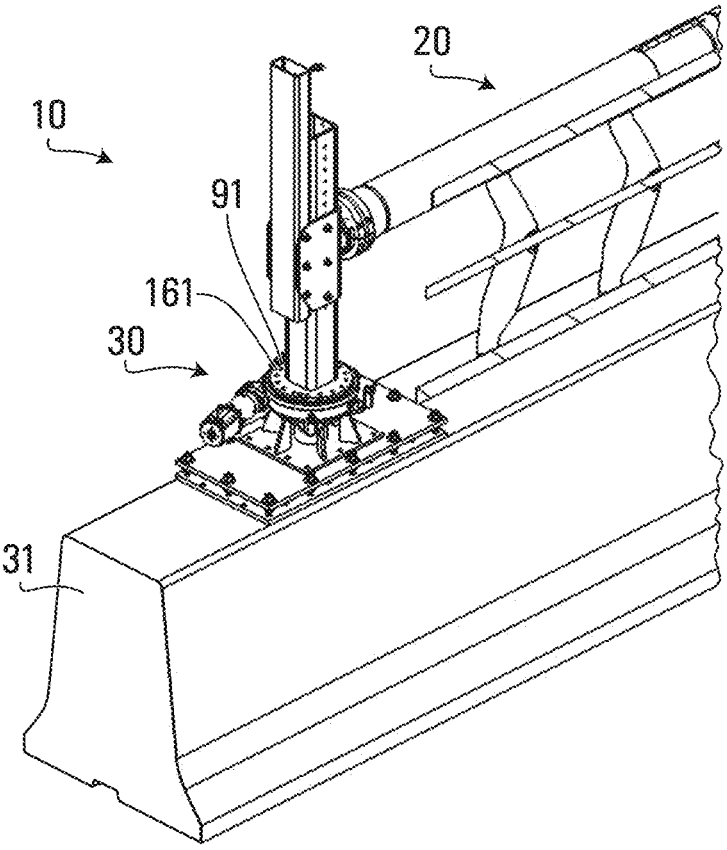
Figure 26:
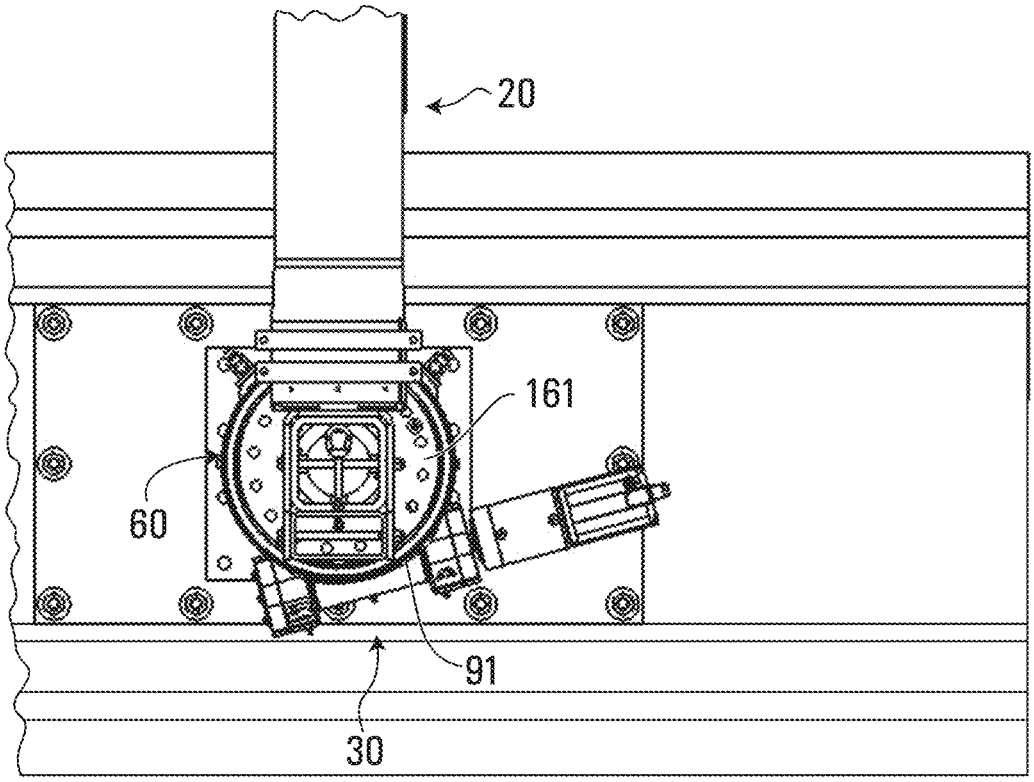
Figure 27:
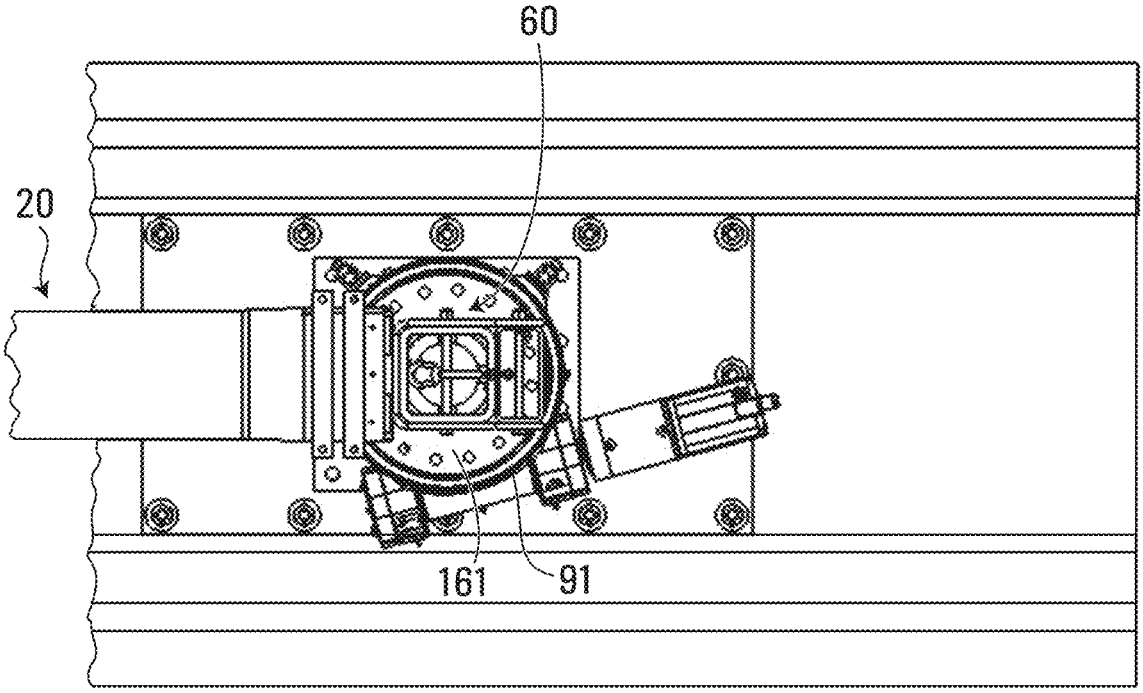

As another example, in other embodiments, as shown in FIG. 20, the arm 20 may comprise a cable 81 (e.g., a wire cable) connecting the support 58 of the control system to the beam 32 at a location along its length to counter a tendency of the arm 20 to deflect along its span.

As another example, in other embodiments, as shown in FIGS. 30 to 38, the control system 30 may be configured such that the arm 20 is movable vertically, instead of horizontally, relative to the control system 30 between its extended position and its retracted position. In yet other embodiments, the control system 30 may be configured such that the arm 20 is movable obliquely, rather than only horizontally or only vertically, relative to the control system 30 between its extended position and its retracted position As another example, in other embodiments, the gate 10 may be mounted in any other suitable way at the roadway 12. For instance, in some embodiments, the traffic barrier 31 may be any other type of traffic barrier (e.g., a roadside barrier, any type of wall). In other embodiments, the gate 10 may be mounted to a pedestal (e.g., a concrete platform which may be embedded into the ground). Also, in some embodiments, the gate 10 may be mounted on a right side of the roadway 12 instead of on a left side of the roadway 12 as shown in embodiments considered above.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments and examples have been presented, this was for purposes of description, but should not be limiting. Various modifications and enhancements will become apparent to those of ordinary skill in the art.

The invention claimed is:

1. A gate for controlling oncoming traffic on a roadway, the gate comprising:

an arm movable between an extended position in which the arm extends into a given portion of the roadway to inform the oncoming traffic that the given portion of the roadway is closed and a retracted position in which the arm does not extend into the given portion of the roadway, the arm comprising:

a beam extending along a longitudinal direction of the arm; and a visible arrangement depending downwardly from the beam and comprising a plurality of visible members that extend obliquely to the beam and are disposed to point towards where the oncoming traffic is to be directed when the arm is in the extended position;

a material of each of the visible members being less stiff than a material of the beam; and a control system comprising an actuator and configured to support the arm and move the arm horizontally between the extended position and the retracted position.

2. The gate of claim 1, wherein the visible members form chevrons pointing towards where the oncoming traffic is to be directed when the arm is in the extended position.

3. The gate of claim 1, wherein the material of the beam is a metallic material and the material of each of the visible members is a polymeric material.

4. The gate of claim 3, wherein the metallic material of the beam comprises aluminum.

5. The gate of claim 1, wherein a ratio of a modulus of elasticity of the material of the beam over a modulus of elasticity of the material of each of the visible members is at least 5.

6. The gate of claim 1, wherein a ratio of a modulus of elasticity of the material of the beam over a modulus of elasticity of the material of each of the visible members is at least 10.

7. The gate of claim 1, wherein: the given portion of the roadway includes a lane; and the arm is configured to be longer than a width of the lane in the extended position.

8. The gate of claim 1, wherein: the given portion of the roadway includes a plurality of lanes; and the arm is configured to extend into each of the lanes in the extended position.

9. The gate of claim 8, wherein the arm is configured to span the lanes in the extended position.

10. The gate of claim 1, wherein a length of the arm is at least 20 ft.

11. The gate of claim 1, wherein a length of the arm is at least 30 ft.

12. The gate of claim 8, wherein a height of the beam from a surface of the roadway when the arm is in the extended position is greater than a height of a passenger car complying with MASH crash-testing.

13. The gate of claim 8, wherein a height of the beam from a surface of the roadway when the arm is in the extended position is no less than a height of a pickup truck complying with MASH crash-testing.

14. The gate of claim 8, wherein a height of the beam from a surface of the roadway when the arm is in the extended position is at least 55 inches.

15. The gate of claim 1, wherein: the visible arrangement comprises a longitudinal member extending along the longitudinal direction of the arm and spaced from the beam; and a material of the longitudinal member is less stiff than the material of the beam.

16. The gate of claim 15, wherein the longitudinal member is disposed at a bottom of the visible arrangement.

17. The gate of claim 16, wherein: the longitudinal member is a first longitudinal member; the visible arrangement comprises a second longitudinal member extending along the longitudinal direction of the arm and spaced from the first longitudinal member and from the beam; and a material of the second longitudinal member is less stiff than the material of the beam.

18. The gate of claim 1, wherein the visible arrangement is retroreflective.

19. The gate of claim 1, wherein the visible arrangement is illuminated.

20. The gate of claim 1, wherein the control system comprises a receiver configured to receive a signal from a remote location to move the arm between the extended position and the retracted position.

21. The gate of claim 1, wherein: the gate is mountable to a traffic barrier for the roadway; and a footprint of the gate on the traffic barrier is contained within a width of the traffic barrier.

22. The gate of claim 1, wherein the visible arrangement is configured to prevent excessive wind deflection.

23. The gate of claim 1, wherein the arm is configured such that a deflection of the arm at a wind speed of 100 km/h is no more than 15°.

24. The gate of claim 1, wherein the gate is MASH crash-tested.

25. The gate of claim 1, wherein the gate is compliant with at least one of (i) MASH evaluation criteria of Test Level 3

Support Structures test matrices and (ii) MASH evaluation criteria of Test Level 3 Work Zone Traffic Control Devices test matrices.

26. The gate of claim 1, wherein the gate is compliant with the MASH evaluation criteria of Test Level 3 Support Structures test matrices and the MASH evaluation criteria of Test Level 3 Work Zone Traffic Control Devices test matrices.

27. The gate of claim 1, comprising a cable connected to the control system at a point above the beam and to the beam at a point remote from a proximal end of the beam.

28. A gate for controlling oncoming traffic on a roadway, the gate comprising:

an arm movable between an extended position in which the arm extends into a given portion of the roadway to inform the oncoming traffic that the given portion of the roadway is closed and a retracted position in which the arm does not extend into the given portion of the roadway, the arm comprising:

a beam extending along a longitudinal direction of the arm and comprising a metallic material; and a visible arrangement depending downwardly from the beam and comprising a plurality of visible members that extend obliquely to the beam, are disposed to point towards where the oncoming traffic is to be directed when the arm is in the extended position, and comprise a polymeric material;

and a control system comprising an actuator and configured to support the arm and move the arm horizontally between the extended position and the retracted position.

29. A gate for controlling oncoming traffic on a roadway, the gate comprising:

an arm movable between an extended position in which the arm extends into a given portion of the roadway to inform the oncoming traffic that the given portion of the roadway is closed and a retracted position in which the arm does not extend into the given portion of the roadway, the arm comprising:

a beam extending along a longitudinal direction of the arm and comprising a metallic material; and a visible arrangement depending downwardly from the beam and comprising a plurality of visible members that extend obliquely to the beam, are disposed to point towards where the oncoming traffic is to be directed when the arm is in the extended position, and comprise a polymeric material;

a height of the beam from a surface of the roadway when the arm is in the extended position being greater than a height of a passenger car complying with MASH crash-testing; and a control system comprising an actuator and configured to support the arm and move the arm horizontally between the extended position and the retracted position.

30. A gate for controlling oncoming traffic on a roadway, the gate comprising:

an arm movable between an extended position in which the arm extends into a given portion of the roadway to inform the oncoming traffic that the given portion of the roadway is closed and a retracted position in which the arm does not extend into the given portion of the roadway, the given portion of the roadway including a plurality of lanes, the arm being configured to extend into each of the lanes in the extended position and comprising:

a beam extending along a longitudinal direction of the arm and comprising a metallic material; and a visible arrangement depending downwardly from the beam and comprising a plurality of visible members that extend obliquely to the beam, are disposed to point towards where the oncoming traffic is to be directed when the arm is in the extended position, and comprise a polymeric material;

and a control system comprising an actuator and configured to support the arm and move the arm horizontally between the extended position and the retracted position.

* * * * *